US012078165B2

(12) United States Patent
Wohlhauser

(10) Patent No.: US 12,078,165 B2
(45) Date of Patent: Sep. 3, 2024

(54) AXIAL PISTON MACHINE WITH CONTROL VALVE

(71) Applicant: Liebherr Machines Bulle SA, Bulle (CH)

(72) Inventor: Patrick Wohlhauser, Giffers (CH)

(73) Assignee: Liebherr Machines Bulle SA, Bulle (CH)

( * ) Notice: Subject to any disclaimer, the term of this patent is extended or adjusted under 35 U.S.C. 154(b) by 65 days.

(21) Appl. No.: 17/490,263

(22) Filed: Sep. 30, 2021

(65) Prior Publication Data

US 2022/0106946 A1 Apr. 7, 2022

(30) Foreign Application Priority Data

Oct. 6, 2020 (CH) ..... 1269/20

(51) Int. Cl.
*F04B 7/02* (2006.01)

(52) U.S. Cl.
CPC ..... *F04B 7/02* (2013.01)

(58) Field of Classification Search
CPC ..... F04B 1/324; F04B 7/02; F04B 49/002; F04B 49/22
See application file for complete search history.

(56) References Cited

U.S. PATENT DOCUMENTS

2008/0080985 A1* 4/2008 Gray ..... F04B 49/03 417/222.1
2015/0337814 A1* 11/2015 Klausmann ..... F04B 1/2042 417/222.1

(Continued)

FOREIGN PATENT DOCUMENTS

CN 106640575 A * 5/2017
CN 106762926 A * 5/2017 ..... F04B 1/295

(Continued)

*Primary Examiner* — Alexander B Comley
(74) *Attorney, Agent, or Firm* — Dilworth & Barrese, LLP

(57) ABSTRACT

The invention relates to an axial piston machine having a swash plate, a drive shaft having a driving mechanism, one or more driving mechanism pivots displaceable therein and whose piston stroke can be set by the swash plate, a mechanical adjustment unit for changing the pivot angle of the swash plate, and an externally controllable control valve. The control valve has a valve housing having a control displaceable control piston, with the adjustment device being hydraulically actuable by the control valve. An adjustment chamber of the control valve is connectable in dependence on the switched state of the control valve to a high pressure inlet or to a low pressure inlet for the hydraulic pressurization of the adjustment device via a setting pressure connection radially extending through the control piston. A connection between a high pressure inlet and a setting pressure connection can be selectively established in regular operation via a first control edge or between the low pressure inlet and the setting pressure connection via a second control edge. In a first aspect, a connection can be established between the low pressure inlet or high pressure inlet via a further control edge in emergency operation without an active control. In a second aspect, a control pressure inlet of the control valve is connectable to a hydraulic tank or to a hydraulic source via an integrated or attached valve. The invention further relates to a control valve for an axial piston machine in accordance with the first aspect.

23 Claims, 11 Drawing Sheets

(56) References Cited

U.S. PATENT DOCUMENTS

| | | | | |
|---|---|---|---|---|
| 2016/0195083 | A1* | 7/2016 | Lingenfelter | F04B 49/08 137/565.13 |
| 2016/0341193 | A1* | 11/2016 | Du | F04B 17/05 |
| 2019/0145389 | A1* | 5/2019 | Wohlhauser | F04B 1/295 91/505 |

FOREIGN PATENT DOCUMENTS

| | | | | |
|---|---|---|---|---|
| DE | 19949169 | C2 * | 10/2001 | F04B 1/324 |
| DE | 102013221625 | A1 * | 4/2015 | F04B 1/324 |
| DE | 112016006012 | T5 * | 9/2018 | F04B 1/20 |
| WO | WO-0127472 | A1 * | 4/2001 | F04B 1/324 |

* cited by examiner 47 third conical edge

In the position of the control piston shown here there is a fluid connection between T and the hollow space 33a cut through the space area between the control piston 31 and the valve housing 32

AXIAL PISTON MACHINE WITH CONTROL VALVE

BACKGROUND OF THE INVENTION

The invention relates to an axial piston machine comprising a drive shaft, a driving mechanism rotationally fixedly connected thereto and having one or more driving mechanism pistons that are axially displaceably received therein and whose piston stroke can be set by a swash plate of the axial piston machine, wherein a setting unit is provided for changing the pivot angle of the swash plate and is hydraulically actuable by means of a controllable control valve of the axial piston machine. The invention further relates to a control valve for such an axial piston machine.

The term axial piston machine includes both an axial piston pump and an axial piston motor. A special design of an axial piston machine is the swash plate machine that comprises a driving mechanism in the form of a driving mechanism drum in which a plurality of driving mechanism pistons are axially displaceably supported in corresponding cylinder bores of the driving mechanism and are supported via their respective sliding blocks at the swash plate that does not follow the drive shaft rotation. The driving mechanism is rotationally fixedly connected to the drive shaft of the axial piston machine that is set into rotation in pump operation by the mechanical power supplied to the drive shaft. In pump operation, the pistons execute a stroke movement forced by the retraction device from a certain starting position onward during the half revolution following it to thereby suck in hydraulic fluid, called hydraulic oil in the following text for better readability, from the low pressure side, whereas they perform a lowering movement forced by the slanted position of the swivel disk during the remaining half revolution of the full rotation about the axis of rotation and the previously sucked in hydraulic oil is thereby brought to the high pressure level and is supplied to the work outlet, i.e. the high pressure side. A reversal of the operating principle is present in motor operation. In this process, a rotational movement of the drive shaft is produced by a controlled pressure actuation of the driving mechanism pistons.

The stroke of the driving mechanism pistons can be set via the pivot angle of the swash plate. The maximum stroke of the driving mechanism pistons results from the maximum possible pivot angle of the swash plate. The minimal stroke of the driving mechanism pistons results from the minimal possible pivot angle of the swash plate. The value of the pivot angle of the swash plate that is desired or is fixed by a regulation is achieved by the setting unit acting on the swash plate by means of a mechanical force transmission. The force results by an oil pressure present in the adjustment chamber, the so-called setting pressure, that acts on the adjustment piston associated with the setting unit there. The pressure level of the setting pressure is specified via a control valve hydraulically connected upstream of the setting unit. There is an oil connection between the control valve and the so-called adjustment chamber.

The control valve receives an input signal, typically in the form of a control pressure provided by a valve unit connected upstream, that transmits the information on the value of the required pressure level of the setting pressure to be set by the control valve. In corresponding applications, a failure of this input signal can result in a safety critical malfunction of the axial piston machine.

In addition to a complete failure of the external control of the control valve, for example on a functional failure of an electrically controlled valve unit or on a cable break, a functional failure of such a unit can also occur due to a hydraulically mechanical defect, for example on a seizing of a valve piston of the valve unit connected upstream via which the control pressure supplied to the control valve is set. In this case, the control pressure does not completely fall to the (relative) value of 0 bar or to the tank pressure level, but rather adopts an intermediate value greater than zero that is not provided by the control or regulation of the axial piston machine, i.e. is arbitrary with respect to the desired behavior, and that differs from that pressure value that would be present in the case of a functional unit. A safety critical malfunction of the axial piston machine can also occur in this process.

It is desirable against this background to design the control valve with a corresponding safety function and/or emergency function that enables/enable an emergency operation of the axial piston machine on the presence of such a functional failure, that is in particular on a failure of the input signal, or on the presence of an unwanted intermediate value of the input signal.

SUMMARY OF THE INVENTION

This object is achieved in a first aspect of the present invention by an axial piston machine having the features herein and in a second aspect of the present invention by an axial piston machine having the features herein. Advantageous embodiments of the invention are the subject of the following description.

In accordance with the invention in accordance with a first aspect an axial piston machine is proposed that comprises a pivotally supported swash plate, a rotationally supported drive shaft, a driving mechanism rotationally fixedly connected to the drive shaft, one or more driving mechanism pistons that are received in the driving mechanism, that are axially displaceably supported, and whose piston stroke is settable by the swash plate, a mechanical adjustment device for varying the pivot angle of the swash plate, and an externally controllable control valve. The control valve has a valve housing having a control piston displaceably supported in a bore, with the adjustment device being hydraulically actuable by means of the control valve. An adjustment chamber of the control valve is connectable in dependence on the switched state of the control valve to a high pressure inlet or to a low pressure inlet of the control valve for the hydraulic pressurization of the adjustment device via a setting pressure connection radially extending through the control piston.

In accordance with the invention, a connection between a high pressure inlet and a setting pressure connection via a first control edge or a connection between the low pressure inlet and the setting pressure connection via a second control edge can selectively be established in regulation operation, i.e. with an active external control of the control valve. In emergency operation, i.e. without an active external control, in contrast, a connection between the low pressure inlet or the high pressure inlet and the setting pressure connection can be established via a further control edge.

It is therefore proposed for the control valve to selectively connect the adjustment chamber of the control valve in which the required pressure level for the hydraulic actuation of the setting unit arranged downstream for the setting of the pivot angle is present to a high pressure inlet or a low pressure inlet of the control valve. If, for example, the setting pressure connection and thus the adjustment chamber is connected to the high pressure inlet of the control valve, the pressure level within the adjustment chamber can be increased and a greater force on the control unit arranged downstream for the adjustment of the pivot angle of the swash plate in a direction can be specified accordingly. If instead the setting pressure connection is connected to the low pressure inlet of the control valve, a change of the pivot angle in the opposite direction can be achieved via a pressure relief of the adjustment chamber to a hydraulic tank The position of the control piston of the control valve is varied via the control. This can take place hydraulically (i.e. the input signal is a control pressure) or also electrically (for example via a proportional magnet).

Provision is specifically made that a fluid connection between the high pressure inlet and the setting pressure connection is provided via a first control edge of the control piston, while a fluid connection between the setting pressure connection and the low pressure inlet takes place via a second control edge of the control piston. If a failure of the regular control of the control valve takes place, the control piston of the control valve moves into a position provided for a safety function or emergency function (=emergency operation) in which a fluid connection is established between the low pressure inlet and the setting pressure connection via a further control edge of the control piston.

In a first variant of the control valve, there is a fluid connection in this position provided for emergency operation between the low pressure inlet and the setting pressure connection that is established via the further control edge of the control piston. On this safety function required for specific applications, a low pressure level is present in the adjustment chamber, e.g. the level of the tank pressure, and the swash plate of the axial piston machine is set to the maximum pivot angle. This is admittedly energetically unfavorable, but ensures that the axial piston machine remains operational or effective. In an embodiment of the invention, an emergency function of the axial piston machine can be made possible by means of the open further control edge in which a pressure is present in the adjustment chamber that is above the tank pressure level.

In a second variant of the control valve, there is a fluid connection in this position provided for emergency operation between the high pressure inlet and the setting pressure connection that is established via the further control edge of the control piston. On this safety function required for specific applications, a high pressure level present at the high pressure inlet in the adjustment chamber, in particular that of the tank pressure, is present and the swash plate of the axial piston machine is set to the minimal pivot angle.

It is possible by this design of the control valve to operate on a complete failure of the external control such that the axial piston machine is switched and further operated in a state favorable for the respective application (e.g. minimal or maximum pivot angle).

In an advantageous embodiment, third and fourth control edges are provided that are configured such in emergency operation (i) that there is a connection between the low pressure inlet and the setting pressure connection via the fourth control edge, while a connection between the high pressure inlet and the setting pressure connection is blocked via the third control edge or (ii) there is a connection between the high pressure inlet and the setting pressure connection via the fourth control edge, while a connection between the low pressure inlet and the setting pressure connection is blocked via the third control edge. The third control edge preferably blocks before the fourth control edge opens on the transition into the emergency operation, that is on the movement of the control piston into an end abutment position provided for the emergency operation.

In a further advantageous embodiment, the setting pressure connection provides at least one radial setting pressure bore, but preferably a plurality of radial setting pressure bores distributed uniformly over the periphery of the control piston. The total flow cross-section of the setting pressure connection is thereby increased. Shear forces that could act on the control piston can be avoided by a plurality of distributed bores.

In a further advantageous embodiment, the further control edge is formed in a region through which hydraulic fluid flows in regulation operation. Since the further control edge is also arranged in the main fluid flow in regulation operation, no deposits can form or no other problems can occur that can be accompanied by a longer non-use of fluid channels/control edges.

In a further advantageous embodiment, the control piston has a setting pressure groove, a high pressure groove, and a low pressure groove that are separated from one another via interposed webs and that are in particular formed as peripheral outer radial grooves. A connection groove that is in particular configured as an inner radial groove is furthermore provided in the inner wall of the valve housing. In regulation operation, a connection can be established between the high pressure inlet and the setting pressure connection via the high pressure groove, the connection groove, and the setting pressure groove and a connection can be established between the low pressure inlet and the setting pressure connection via the low pressure groove, the connection groove, and the setting pressure groove.

The housing of the control valve furthermore preferably comprises at least one housing high pressure groove and a housing low pressure groove that are in particular each designed as radial grooves extending along its outer periphery. There is at least one bore from the groove base of the housing high pressure groove piercing the housing wall. Irrespective of their number, these bores are overall called a housing high pressure bore. There is at least one bore from the groove base of the housing low pressure groove piercing the housing wall. Irrespective of their number, these bores are overall called a housing low pressure bore. In regulation operation, a fluid connection can thereby be produced between the high pressure infeed to the control valve and the setting pressure bore via the housing high pressure groove, the housing high pressure bore, the high pressure groove, and the setting pressure groove. A connection between the low pressure infeed and the setting pressure bore is, on the other hand, generated in regulation operation via the housing low pressure groove, the housing low pressure bore, the low pressure groove, and the setting pressure groove. In emergency operation, in contrast, a connection is made possible between the low pressure infeed and the setting pressure bore via the housing low pressure groove, the housing low pressure bore, and the setting pressure groove.

In a further advantageous embodiment, the setting pressure connection opens into the setting pressure groove, with the webs bounding the setting pressure groove each having at least one cutout in the region of the opening of the setting pressure connection that form a common volume with the low pressure grooves or high pressure grooves disposed on the other sides of the webs and that reduce the width of the webs. The cutouts preferably have a width that reduces toward the setting pressure groove. The cutouts can be circular counterbores that can have the same depth as the low pressure grooves or high pressure grooves or can have a smaller/greater depth. Instead of a circular shape, different forms can also be used, for example (viewed from above), a trapezoidal, triangular, ellipsoid, or otherwise conical shape of the cutout. The base of the cutouts can be chamfered relative to the adjacent groove base.

The first and/or second control edge(s) is/are preferably formed at the regions of reduced widths of the webs. It is achieved by these cutouts that a comparatively large position change of the control piston in the transition region effects a comparatively small change of the opening cross-section of the control edges.

In a further advantageous embodiment, a connection takes place in emergency operation between the low pressure inlet or high pressure inlet and the setting pressure connection directly via the setting pressure groove, i.e. not via the high pressure groove or low pressure groove.

In a further advantageous embodiment, the control piston is designed as a hollow piston, with the control piston having a hollow space that has a permanent fluid connection with the adjustment chamber.

In a further advantageous embodiment, the control piston is designed as a pot-shaped hollow piston, with its open longitudinal side facing the setting piston.

In a further advantageous embodiment, the control valve has a compression spring called a feedback spring that is supported directly or indirectly between the control piston of the control valve and the setting piston of the axial piston machine. The spring force of the feedback spring acts against a setting force on the control piston generated by the control signal or the input signal, with the spring force preferably increasing as the pivot angle of the swash plate increases. In other words, the return force of the feedback spring acts against a force on the control piston generated by the control of the control valve (for example from the control pressure) and is, for example, reinforced by the mechanically hydraulic return action of the adjustment device with an increasing pivot angle of the swash plate.

In regulation operation, there is an equilibrium of force between the return force of the adjustment unit, on the one hand, and the force acting on the setting piston by the setting pressure or the force generated on the control piston by means of the control, on the other hand, so that the position of the control piston remains stationary without a change of the control. So that such an equilibrium of force is present exactly under this condition even though the setting pressure acts on the side facing the adjustment direction of the control piston, the control piston can have an additional active surface on its oppositely disposed front side that is acted on by a corresponding pressure. The blind hole bore of the valve housing for the reception of the control piston is preferably designed as lower than the piston length so that the corresponding volume is present between the blind hole base of the valve housing and the front surface of the control piston facing the base. This volume is preferably connected via an axial bore through the front surface of the control piston directed toward it to its hollow space so that the corresponding setting pressure level is likewise present in this additional volume. The setting pressure thereby has no effect on the piston position of the control piston. The axial bore preferably comprises at least one diameter restriction to compensate possible pressure fluctuations by the restrictive effect thereby caused and/or to effect a damped functional movement of the control piston.

In a further advantageous embodiment, the fluid connection between the control valve and the adjustment chamber extends over the mutually facing front sides of the control piston and of the adjustment chamber.

In a further advantageous embodiment, the control valve is hydraulically controlled, with a corresponding control chamber having a correspondingly aligned control surface preferably being formed for this purpose by a radial groove at the outer periphery of the control piston.

In accordance with a preferred embodiment, a higher control pressure level is required for opening the first control edge than for opening the second control edge- The adjustment chamber of an axial piston machine is generally formed by the volume that is enclosed by the active surface of the setting piston and the blind hole bore accommodating the setting piston. In a further advantageous embodiment, the adjustment chamber is formed by the volume between the active surface of the setting piston and the blind hole bore accommodating the setting piston and the connection region up to the open front side of the control piston.

In accordance with an embodiment, the adjustment device comprises a corresponding setting piston that acts on the swash plate via a mechanical connection, for example in the form of a setting lever.

In a further advantageous embodiment, the setting piston has an axial projection at its active surface that can penetrate into the open front side of the control piston. The blind hole bore of the control valve housing can have an enlarged bore diameter in the region of the interface to the setting unit. At least one ring can be introduced into the annular space formed in this manner between the control piston and this blind hole bore, said ring coaxially surrounding the control piston and representing a contact surface having particularly favorable sliding properties for it. It is also conceivable that the ring simultaneously serves as an axial abutment surface for the control piston. The ring can be fastened in the blind hole bore of the valve housing by means of a securing element, in particular a shaft securing element.

In a further advantageous embodiment, the control valve is designed in a cartridge construction. A releasable introduction of the control valve into the axial piston machine, i.e. into the provided housing bore of the axial piston machine, is also of advantage. In this respect, an arrangement of the control valve within the connection plate of the axial piston machine has proven to be particularly advantageous, in particular when this control valve is designed in a cartridge construction. In a particular embodiment, the control valve is screwable into the housing, in particular into the connection plate, from the outside.

In a further advantageous embodiment, in emergency operation the maximum or minimal pivot angle of the swash plate is present at a maximum/minimal driving mechanism piston stroke.

In a further advantageous embodiment, the low pressure inlet of the control valve is connected to the tank of the hydraulic oil so that in a certain operating state the setting pressure corresponds to the low pressure of the tank and the maximum hydraulic device comprising the axial piston machine and the control valve is equipped with one or more additional valve units or regulation valves via which the low pressure inlet of the control valve is connected to the tank. The integration of a load sensing stage and/or of a pressure cutoff is conceivable here, for example, that can either be an integral component of the axial piston machine or can be attached thereto. An external connection of corresponding valve units to the low pressure inlet of the control valve is naturally also possible.

The low pressure outlet can be acted on by a pressure level above a tank pressure level by means of such a regulation valve, whereby an emergency function of the axial piston machine can be implemented in emergency operation, i.e. on a failure of the external control of the control valve, a certain, in particular a settable, pressure level is provided via the further control edge so that the pivot angle of the axial piston machine adopts a value lying between the minimal and the maximum angles.

Instead of a regulation valve such as the mentioned pressure cutoff or load sensing stage, a simpler valve such as a 2/2 way valve can also be connected to the low pressure inlet of the control unit. A connection to the tank can be established by means of the valve for the provision of the tank level at the low pressure inlet (this corresponds to the previously described safety function in which the axial piston machine is operated in emergency operation at a maximum pivot angle) or a connection to a hydraulic source such as a hydraulic pump for providing a pressure level lying above the tank level at the low pressure inlet (this corresponds to the previously described emergency function in which the axial piston machine is operated in emergency operation at a certain angle below the maximum angle). The 2/2 way valve can only have the switched positions open or closed, which represents an inexpensive and robust solution.

In the event that the low pressure inlet is connected to the hydraulic tank via such hydraulic components, a volume flow regulation of the axial piston machine can take place with a lower upper dynamic level in a certain operating state by means of the load sensing stage and/or by means of the pressure cutoff in the emergency function.

In all the cases of the previously explained emergency function the working pressure of the axial piston machine can naturally also be provided as the pressure level instead of an intermediate value so that the axial piston machine adopts a minimum pivot angle in emergency operation. The provided ed pressure level in the emergency function can likewise be a pressure level at which the axial piston machine works in accordance with a preferred speed/volume flow characteristic.

In a further advantageous embodiment, the control valve has a control pressure inlet connected to a control chamber in which an externally provided control pressure, in particular provided via one or more hydraulic components such as a pressure reducing unit, is applied, with the piston position of the control piston depending on the amount of the control pressure and with the control valve preferably being configured such that it automatically transitions into the emergency operation on a failure of the control pressure.

In a further advantageous embodiment, a pressure monitoring device is provided by means of which the control pressure or the pressure present at the control pressure inlet is detectable and is comparable with a desired value, with the control pressure inlet being able to be acted on by a tank pressure level (safety function) or a settable pressure level (emergency function) on a presence of a deviation of the measured control pressure from the desired value, in particular by an electrical control of at least one hydraulic component connected upstream of the control valve. The latter can be a pressure reducing unit connected to the control pressure inlet or a 2/2 way valve as described above. It is thereby possible not only to transition into emergency operation on a complete failure of the control pressure (e.g. by a failure of the electronics, for example triggered by a cable break), but also on other disturbances in which the control pressure does not fall to (relative) 0 bar, but rather adopts a pressure value differing from the desired value. An example for such a case is the seizing of a piston of a hydraulic component that serves to provide the control pressure (so-called piston seizure). The pressure monitoring device preferably comprises a pressure sensor that is connected to a hydraulic line connected to the control pressure inlet.

In accordance with the invention, in a second aspect of the invention, an axial piston machine of the category is proposed whose control valve has a control pressure inlet that is connected to an control chamber and in which an externally provided control pressure is present, with the piston position of the control piston depending on the amount of the control pressure. An integrated or attached valve, in particular a 2/2 way valve, is connected to the control pressure inlet of the control valve by means of which the control pressure inlet is connectable to a hydraulic tank or, for the action on a pressure level above the tank pressure level, to a hydraulic source, in particular a hydraulic pump.

It is likewise possible by this solution to enable a safety function or an emergency function of the control valve. On a failure of the electrical control of the hydraulic component(s) that provide(s) the control pressure, the tank pressure or a certain pressure level (it can also be the working pressure in addition to an intermediate pressure) can be provided at the control pressure inlet via the valve to set the pivot angle of the axial piston machine to a certain value for emergency operation. A failure of the electronics in this respect advantageously likewise automatically results in a switching of the valve to provide the corresponding connection for the emergency function or safety function.

In an advantageous embodiment, a pressure reducing unit by means of which a working pressure of the axial piston machine can be reduced to the control pressure is connected in parallel with the valve, with the pressure reducing unit preferably being electrically controllable.

In a further advantageous embodiment, the valve is electrically controllable and is configured such that the control pressure inlet is connected to the hydraulic tank or to the hydraulic source without an electrical control of the control pressure inlet, whereas the connection is interrupted on an electrical control.

In a further advantageous embodiment, the control valve is configured in accordance with a control piston in accordance with the invention that was described within the framework of the axial piston machine in accordance with the first aspect. I.e. the control piston has at least one further control edge via which a connection between the low pressure inlet or the high pressure inlet and the setting pressure connection can be established in emergency operation. The previously treated advantageous embodiments apply in an analog manner.

The present invention further relates to a control valve for an axial piston machine in accordance with the invention in accordance with the first aspect of the invention. In this respect, the same advantages result for the previously explained axial piston machine in accordance with the invention so that a repeat description is dispensed with here.

BRIEF DESCRIPTION OF THE DRAWINGS

Further advantages and properties of the invention will be explained in more detail in the following with reference to the embodiments shown in the Figures. There are shown.

DESCRIPTION OF THE PREFERRED EMBODIMENT

Figure 1:
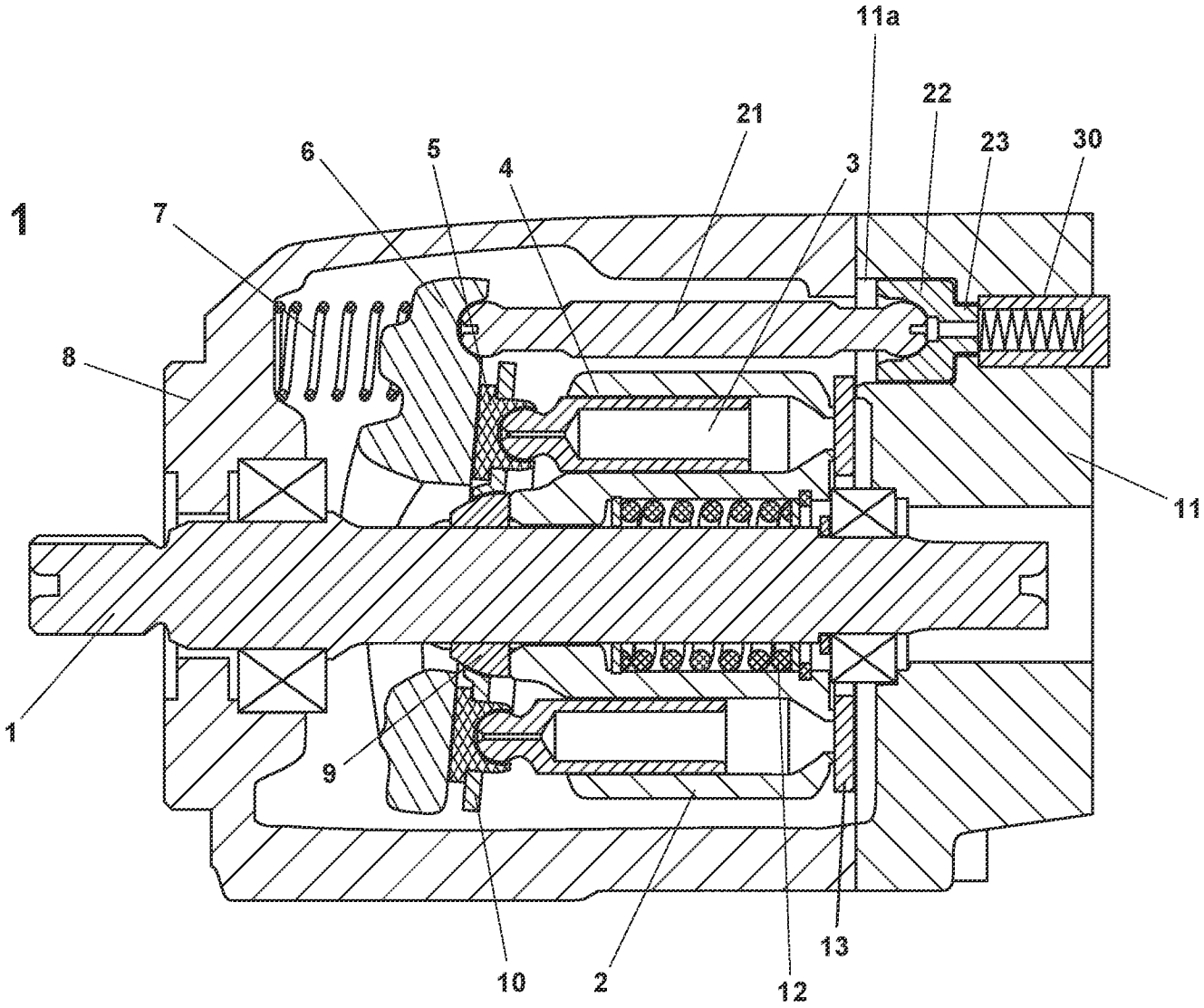
FIG. 1: a longitudinal section through the axial piston machine in accordance with the invention in accordance with an embodiment.

FIG. 1 shows an axial longitudinal section through an axial piston machine serving as an embodiment, with it being a simplified illustration that is not to scale. The control valve 30 that is shown in simplified form here is preferably integrated in the connection plate 11 of the axial piston machine. The invention will be described in the following with reference to an axial piston pump; however, it is explicitly pointed out that the features of the invention in accordance with the invention can also be used without limitation in an axial piston motor. In pump operation of an axial piston machine, a conversion takes place from mechanical into hydraulic power and in motor operation, a reversal of such a power conversion is present.

The axial piston machine has a housing 8 in which a swash plate 6 is pivotably supported. A rotatably supported drive shaft 1 is led through the swash plate 6. A driving mechanism 2, here a cylinder drum in which a plurality of cylinder bores 4 equipped with driving mechanism pistons 3 are worked, is seated on the drive shaft 1. The driving mechanism pistons 3 are each supported on the swash plate 6 via a sliding block 5. On a rotation of the driving mechanism 2 about the axis of rotation of the drive shaft 1, the sliding blocks 5 of the driving mechanism pistons 3 following the rotational movement are pressed in the proportions of their working cycles, in which there is an excess pressure of the hydraulic oil applied to the driving mechanism pistons 3, by this excess pressure and during the remaining portion of the respective working cycles by the retraction device at the slanted sliding surface of the non co-rotating swash plate 6, whereby a stroke movement of the driving mechanism pistons 3 is forced in their longitudinal direction.

Components of the retention device are the retraction plate 10 connected to the driving mechanism 2 and the retraction ball 9 seated on the drive shaft 1 and rotationally fixedly connected thereto. Said retraction ball 9 is urged in the direction of the swash plate 6 by the return force of the central spring 12 via the driving mechanism drum 2 and in so doing is supported on the retraction plate 10 that engages at the overhangs of the sliding blocks 5 and presses them onto the swash plate 6. The driving mechanism 2 is additionally pressed in the direction of the control plate 13 by the central spring 12. The stroke of the driving mechanism pistons 3 results by the pivot angle of the swash plate 6 that can be specified via an adjustment device 20 in operation.

The swash plate 6 is pivoted by a setting lever 21 of the adjustment device 20 axially displaceably supported in the axial piston machine. In the embodiment in accordance with FIG. 1, the setting force of the setting lever 21 is directed against the spring force of a return spring 7 that is supported between the housing 8 and the swash plate 6. The setting lever 21 has a spherical region at its end side via which it is connected in an articulated manner and preferably via a spherical joint to the swash plate 6. The setting lever 21 is preferably rotationally symmetrical to its longitudinal axis and/or has mirror symmetry to its vertical axis and extends in the axial direction approximately in parallel with the drive shaft 1 from the swash plate 6 up to a setting piston 22 that is displaceably guided in the connection plate 11 and that is in active connection with the control valve 30 in accordance with the invention. The axis of symmetry of the drive shaft 1 and the longitudinal axis of the setting lever 21 lie on a common plane that is always identical independently of the position of the setting lever 21.

The spherical setting lever end disposed opposite the swash plate 6 contacts the setting piston 22 that preferably has the matching ball socket there. The articulated and preferably spherical joint connection between the setting lever 21 and the swash plate 6 can be designed such that the setting lever 21 locks, e.g. is guided via a bayonet-like design of the articulated connection, in every operating state of the axial piston machine. The same also applies to the connection between the setting lever 21 and the setting piston 22. The setting piston 22 is axially displaceably supported within a blind hole bore 11*a* introduced into the connection plate 11. The setting piston 22 has a small cylindrical overhang 23 on its front surface disposed opposite the socket via which overhang 23 a feedback spring 33 of the control valve 30 is guided. Two abutments in the region of the blind hole 11*a* provide the boundary of the axial movement of the setting lever 21. A first abutment for bounding the maximum flow rate $Q_{max}$ is formed by the base of the blind hole 11*a* so that here the maximum insertion distance of the setting lever 21 into the blind hole 11*a* is bounded.

A second abutment forms the $Q_{min}$ abutment that is formed by a step of the housing 8 in the transition to the connection plate 11.

FIGS. 2 to 9 relate to a first aspect of the invention.

Figure 2:
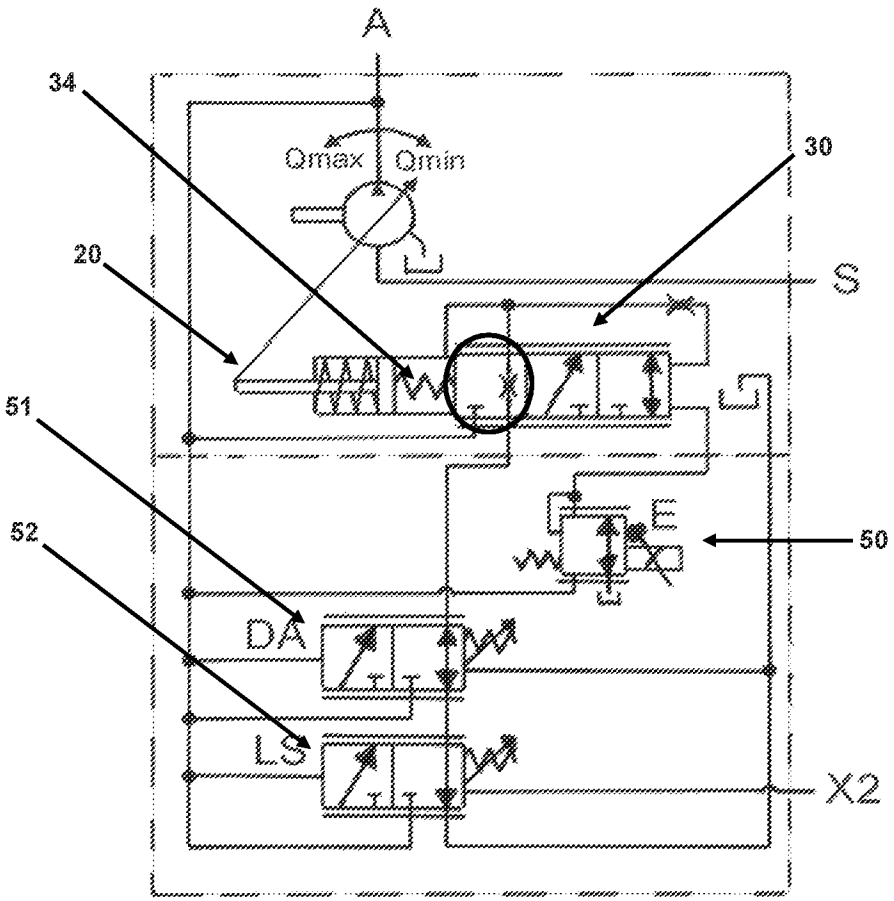
FIG. 2: a circuit diagram of a hydraulic device in accordance with the invention that has an emergency function having a control valve in accordance with the first aspect of the invention.

FIG. 2 shows a circuit diagram of a hydraulic device in accordance with the invention that has an emergency function having a control valve 30 in accordance with the first aspect of the invention; The control valve 30 in accordance with the invention is hydraulically controlled via a control pressure inlet ST. This is shown, for example, in the circuit diagram of FIG. 2 and in FIG. 3. The control pressure inlet ST of the control valve 30 is acted on by the outlet pressure (also called the control pressure) of an electrically controlled component, a pressure reducing unit 50 in the embodiment. If the electrical control signal E for the pressure reducing unit 50 fails, for example on a cable break, it closes completely, whereupon the control pressure drops at the inlet ST of the control valve 30. The control valve 30 hereby provides the possibility of a safety function.

In an application in which a continued operation of the axial piston machine is advantageous or necessary on a failure of the control pressure, e.g. with a fan driven by the axial piston machine, a control valve 30 in accordance with a first variant is used in which the maximum pivot angle is set in emergency operation. In another application in which a shutdown of the axial piston machine is necessary on a failure of the control pressure, e.g. with a rotational mechanism driven by the axial piston machine, a control valve 30 of a second variant is used in which the minimal pivot angle is set in emergency operation. Such a safety function is naturally already present for a control valve 30 in accordance with the invention when its low pressure inlet T is directly connected to the hydraulic oil storage tank and the tank pressure is therefore present at the low pressure inlet T. FIGS. 2 to 9 relate to a control valve 30 of the first variant.

An emergency function of the at least one axial pivot machine going beyond the functional extent of the safety function (=short circuit to the tank) can be achieved (see below) with the aid of an expansion of the control valve 30 by at least one further hydraulic valve that is hydraulically connected upstream of the low pressure inlet T of the control valve 30 and via which the low pressure inlet T can be acted on by a variable pressure level above the tank level. If a hydraulic valve that has this possibility is anyway already present in the hydraulic system in another manner, it can be included for implementing this emergency function.

In summary, in the present case, the operation of the control valve 30 is called an emergency operation on a failure of the external control (in particular of the control pressure) whereas an embodiment (in accordance with the first variant) in which the tank pressure is present at the low pressure inlet T in emergency operation is called a safety operation and an embodiment in which a pressure level above the tank pressure is present at the low pressure inlet T in emergency operation is called an emergency functions.

In the embodiment in accordance with FIG. 2, the low pressure connection T of the control valve 30 is not directly connected to the hydraulic oil storage tank, but rather via a respective control edge of a pressure cutoff 51 and of a load sensing valve 52 that can anyway be provided, for example, to satisfy other work in the hydraulic system. The low pressure level supplied to the control valve 30 can therefore be higher than the tank pressure level present in the hydraulic oil storage tank (emergency function) so that the low pressure connection T can also be called a regulation pressure connection in such an arrangement. If the output signal of the pressure reducing unit 50 (that is the control pressure) were to fail due to a defect, the control piston 31 of the control valve 30 is first gradually urged by the feedback spring 33 to the switching position respectively this end position adopted in the circuit diagram of FIG. 2 and marked by the circle, and indeed independently of whether the apparatus in accordance with the invention only has the safety function or the capability of an emergency function. As mentioned, this position of the control piston 31 is made possible by the presence of the control valve 30 in accordance with the invention.

Instead of the regulation valves 51, 52, a different valve, for example a simple 2/2 way valve, can also be connected to the low pressure inlet T via which 2/2 way valve a connection to the tank or to a hydraulic high pressure source can be established by a corresponding (preferably electrical) switching. On a connection to a tank, a safety function is made possible; on connection to a pressure source, an emergency function. The valve can here be configured such that the connection to the tank/pressure source is present on a failure of the electronic actuator switching the valve. The corresponding safety function or emergency function is thereby automatically activated on a global failure of the electronics that also relates to the provision of the control pressure and triggers emergency operation. The 2/2 way valve can be the valve provided with reference numeral 53 in FIG. 10 based on its design. Unlike the embodiment shown in FIG. 10 and as already mentioned, it can be connected to a hydraulic high pressure source instead of a tank.

A first aspect of the invention relates to the advantageous design features of the control valve 30 that are described in the following text.

If the low pressure inlet T of the control valve 30 has a direct oil connection to the hydraulic oil storage tank (unlike the embodiment in accordance with FIG. 2), the pivot angle of the swash plate 6 would adopt its maximum value once the control piston 31 has reached its end position, whereby the maximum possible stroke of the driving mechanism piston 3 would be present. A conveying of the maximum volume flow $Q_{max}$ hereby takes place at the respectively present speed of the axial piston pump. With the proviso that there can be no risk of an overload of the hydraulic pump, the hydraulic lines, etc. under these operating conditions, such a mode of operation of the axial piston pump can, as mentioned, be the safe operating state for certain applications, e.g. when the axial piston pump is used for a cooling function.

FIG. 2 shows an apparatus in accordance with the invention having an expanded functional extent that is present due to the presence of the two hydraulic valves 51, 52 additionally present in the circuit diagram. It is here a pressure cutoff (DA) 51 and a load sensing unit (LS) 52 that can both be designed in a manner known per se. If the pressure level at its working outlet A reaches a certain threshold in emergency operation of the axial piston pump, a reduced pressure level is formed via the pressure cutoff 51 from the high pressure present at the work output A and is supplied to the low pressure inlet T of the control valve 30 and thus ultimately to the adjustment chamber 34. A further increase of the pressure level at the work output A of the axial piston machine results in an increasing increase of the pressure level supplied to the adjustment chamber 34 via the pressure cutoff 51, which is accompanied by a greater pivoting back of the swash plate 6.

There is a special focus on the achieving of a small component length in the embodiment of the control valve 30 in accordance with the invention. For this reason, the flow cross-section present in the presence of emergency operation by the control valve 30 has a constriction (see below), whereby a an oil flow in the direction of the adjustment chamber 34 and coming from the adjustment chamber 34 is considerably smaller than over the main control edges, i.e. a first control edge 41 and a second control edge 46. The upper dynamic limit at which a position change of the setting piston 22 can be triggered is accordingly considerably restricted under such an emergency operation of the axial piston pump (cf. FIG. 2) or generally for an axial piston machine.

From the perspective of an operator application, such an emergency operation can be used for an axial piston machine serving as a travel drive of a mobile work machine: if a failure of the setting pressure at the setting pressure inlet ST occurs in this process—for example by an interruption of the electrical control of the pressure reducing unit 50—the mobile work machine can be directly removed by the emergency operation from a hazard zone or a zone where, for example, a broken down vehicle represents an obstacle.

A higher availability of an emergency operation can self-evidently be achieved when the hydraulic valve 51, 52 used for this purpose is not electrically controlled, but rather hydraulically, for example, since a failure or a disturbance in the electronics that results in a functional failure of the proportional magnet of the pressure reducing unit 50 and that triggers the emergency operation, e.g. can also occur in the voltage supply of the total electrics/electronics and the emergency function in such a case could naturally not be carried out by another electrically controlled element. However, the safety functions is even maintained in such a case when using a control valve 30 in accordance with the invention.

Figure 3:
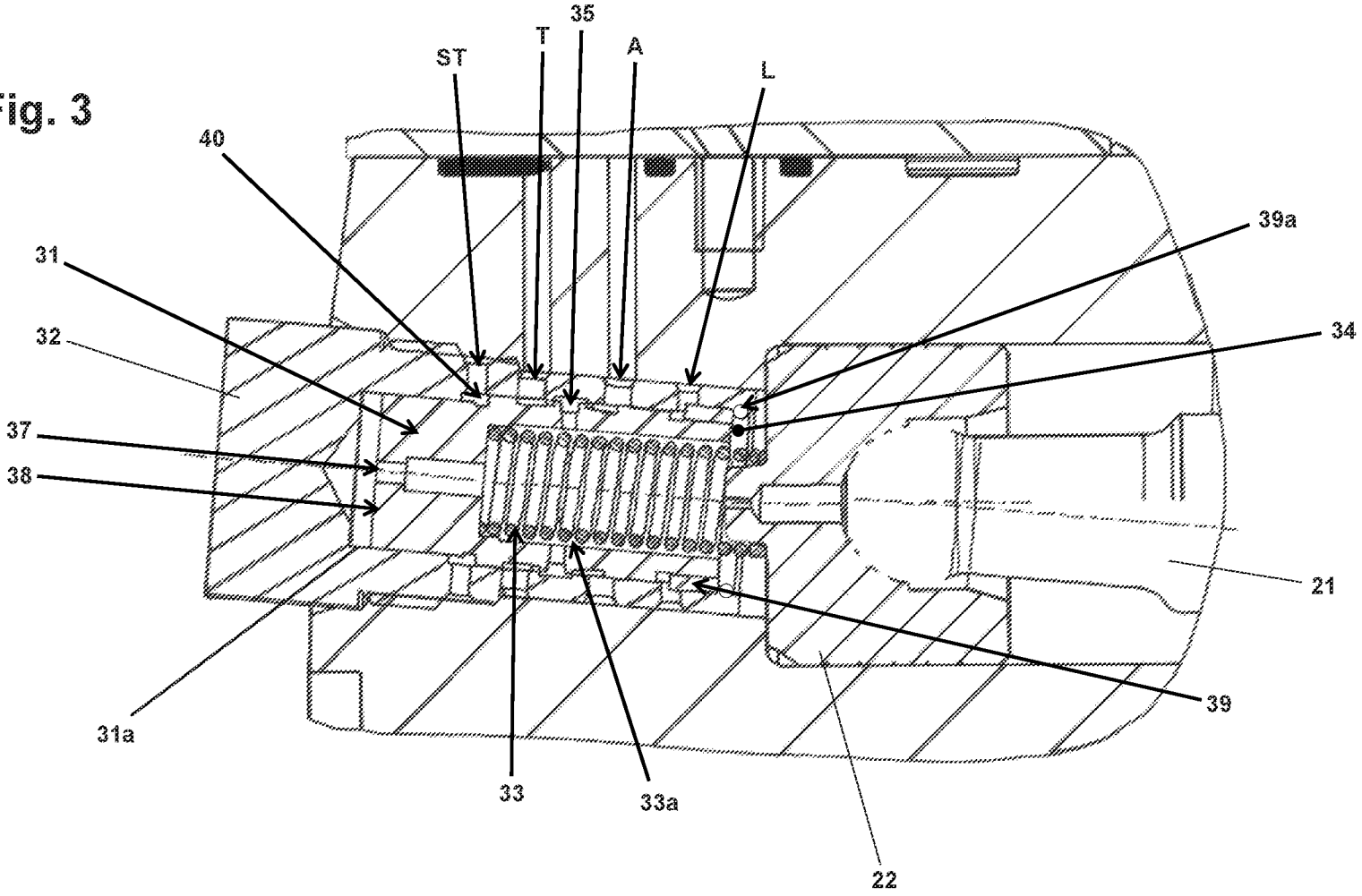
FIG. 3: in cross-section, a detail view of a control valve in accordance with the invention that is advantageously integrated in an axial piston machine.

The control valve 30 of the axial piston machine is integrated in its connection plate 11 in the volume flow regulation presented here. The hollow space 33*a* of the pot-shaped control piston 31 serving as a spring chamber merges directly into the blind hole bore 11*a* accommodating the setting piston 22 and thus into the adjustment chamber 34, i.e. into that hollow volume in which the application of the setting pressure to the setting piston 22 takes place. One of the three following states is present in dependence on the position of the control piston 31 in the control valve 30 in regulation operation:

a) There is an oil connection between the high pressure inlet A and the setting pressure connection (implemented here by a plurality of radial setting pressure bores 35—cf. FIG. 3) in the control valve 30. There is in this case with respect to the total connection and accordingly equally in the real arrangement an oil connection from the high pressure outlet A of the axial piston pump to the adjustment chamber 34 (FIG. 2: middle switched state of the control valve 30).

b) The adjustment chamber 34 is connected to the low pressure inlet T (FIG. 2: right switched state of the control valve 30).

c) The adjustment chamber 34 is not connected to either the high pressure inlet A or to the low pressure inlet T (FIG. 2: intermediate position between the middle and right switched states of the control valve 30)Å.

A specific design of a preferred embodiment for a control valve 30 in accordance with the invention can be seen from the detail view in accordance with FIG. 3. The control valve 30 is in a cartridge-like housing 32 that is screwed into the connection plate 11 of the axial piston pump and can in this respect in particular be screwed in from the outside. FIG. 3 shows the setting piston 22 in its end abutment position on the presence of the maximum pivot angle of the swash plate 6. An embodiment is further shown here in which the control valve 30 is arranged in the connection plate 11 such that its longitudinal axis is not perpendicular, but rather obliquely to the front side of the setting piston 22. The control valve 30 can, however, equally be oriented in parallel with the longitudinal axis of the setting piston 22 or setting lever 21, i.e. the longitudinal axis of the control valve 30 can be arranged perpendicular to the front side of the setting piston 22.

The feedback spring 33 of the control piston 31 is supported at the setting piston 22. The return force acting on the control piston 31 by the feedback spring 33 is thereby influenced by the position of the setting piston 22, i.e. by the pivot angle or respectively by the volume flow related to the speed of the drive shaft 1. The control piston 31 is designed as a pot-shaped hollow piston, with the closed front side 38, i.e. the outer pot base surface of the control piston 31 is on the side remote from the setting piston 22. The contact surface of the feedback spring 33 in the control piston 31 is its blind hole base, i.e. the inner pot base surface. A large longitudinal section of the feedback spring 33 is located in the inner hollow volume of the control piston 31. In said end abutment position of the setting piston 22 in accordance with FIG. 3, practically the whole feedback spring 33 is in the hollow volume of the control piston 31. This provides the advantageous possibility of a design of the control valve 30 with a particularly small construction length.

In accordance with the illustration of FIG. 3, the jacket surface of the housing 32 of the control valve 30 has at least four radial grooves. Starting from the respective groove base of these grooves, there is at least one continuous bore in each case. These bores respectively starting from a certain groove can in turn be divided into four groups: control pressure ST, lower pressure T, high pressure A, and leak L. Such a bore is preferably oriented radially toward the longitudinal axis of the control valve 30. For better readability, the selection of words control pressure bore ST, low pressure bore T, high pressure bore A, and leak bore L or leak connection are used in the following text. However, a plurality of such bores as respective parallel oil connections are preferably respectively present for each of these connections. In the screwed-in control valve 30, said grooves impact the corresponding oil pressure bores introduced into the connection plate 11, whereby the oil connections to the control valve 30 in accordance with the circuit diagram (FIG. 2) are produced. The low pressure bores and high pressure bores extending through the connection plate 11 of the axial piston pump can be seen in the section of FIG. 3, whereas the control pressure bore and the leak bore are arranged behind the control valve 30 and are therefore not visible.

An inner radial groove that is called a connection groove 36 is furthermore present in the control valve 30 in the wall of its piston bore 31*a* in that longitudinal section that is disposed opposite a setting pressure groove 35*a* of the control piston 31 formed as an outer radial groove in regulation operation of the control valve 30 (see below).

An outer radial groove that is called a setting pressure groove 35*a*, that preferably extends over the total periphery of the control piston 31, and whose base surface is adjoined by at least one continuous bore 35 is introduced at the outer side of the jacket wall of the control piston 31. Independently of the number of these bores 35 that serve as parallel oil connections and that each pierce a portion of the groove base, the term setting pressure bore 35 is used therefor. The inflow of hydraulic oil coming from the high pressure connection A into the adjustment chamber 34 on a corresponding axial position (cf. FIG. 6) of the control piston 31 takes place along the setting pressure bore(s) 31 via the hollow space 33*a* of the control piston 31 that is simultaneously the spring chamber 33*a* of the feedback spring 33 in the embodiment in accordance with FIG. 3, likewise the oil outflow into the low pressure connection T on a corresponding axial position (cf. FIG. 4) of the control piston 31.

The outer side of the jacket wall of the control piston 31 has, in addition to the setting pressure groove 35*a*, two further outer radial grooves preferably extending over the total periphery of the control piston 31: a low pressure groove 44 that is separated from the setting pressure groove 35*a* by a web 45 is located to the left of the setting pressure groove 35*a* (in the direction of the blind hole base of the bore 31*a*), a high pressure groove 42 that is likewise separated from the setting pressure groove 35*a* by a web 43 is located to the right of the setting pressure groove (in the direction of the setting piston 22). The lower pressure and high pressure grooves 42, 44 can have the same depth and/or width or can have different depths and/or widths. The setting pressure groove 35*a* can furthermore be deeper than the low pressure and/or high pressure grooves 42, 44. The webs 43, 45 can have the same width or different widths.

Not only a single one, but rather a plurality or radial setting pressure bores 35 are preferably provided, particularly preferably a plurality of radial setting pressure bores 35 evenly distributed over the periphery of the control piston 31 or of the setting pressure groove 35*a*, said radial setting pressure bores 35 forming the setting pressure connection in their totality. By the provision of a plurality of parallel radial bores 35, the total flow cross-section of the setting pressure connection is enlarged, on the one hand, (to be able to move the setting lever 21 fast, a relatively large volume of hydraulic fluid has to be made available in a short time) and the occurrence of shear forces acing on the control piston 31 is avoided, on the other hand.

The diameter of the bores 35 producing the setting pressure connection self-evidently have to be correspondingly large as a result of the function so that no restrictive effect is produced, but on the other hand they have to be small enough to make possible a small construction length of the control piston 31 or of the control valve 30 respectively. The width of the setting pressure groove 35*a* preferably has the same extent or substantially the same extent as the diameter of the setting pressure bores 35 that are in turn preferably positioned at the groove base and particularly preferably centrally at the groove base. This enables a comparatively large total cross-section of the setting pressure connection, i.e. of the oil connection extending through the wall of the control piston 31, with a comparatively small construction length requirement of the control piston 31 or of the control valve 30 respectively. It is hereby achieved that the dynamics of the swash plate adjustment is not limited or is not limited too much by the flow cross-section of the setting pressure connection.

The control piston 31 has a leak groove 56 (cf. FIG. 9) that is formed as a preferably completely peripheral outer radial groove in the region of the leak bore L. The leak groove 56 is preferably adjacent to the contact surface of the ring 39. Alternatively or additionally, the leak groove 56 has at least one continuous bore starting from the groove base, whereby a fluid connection is present between the hollow volume of the control piston 3 that is the spring chamber 33*a* in the embodiment, and the leak connection L of the control valve 30. There are particularly preferably a plurality of such bores, with their hole diameters being substantially smaller than that/those of the setting pressure bore(s) 35. The bores piercing the leak groove 56 are very particularly preferably evenly distributed over their peripheries.

Figure 9:
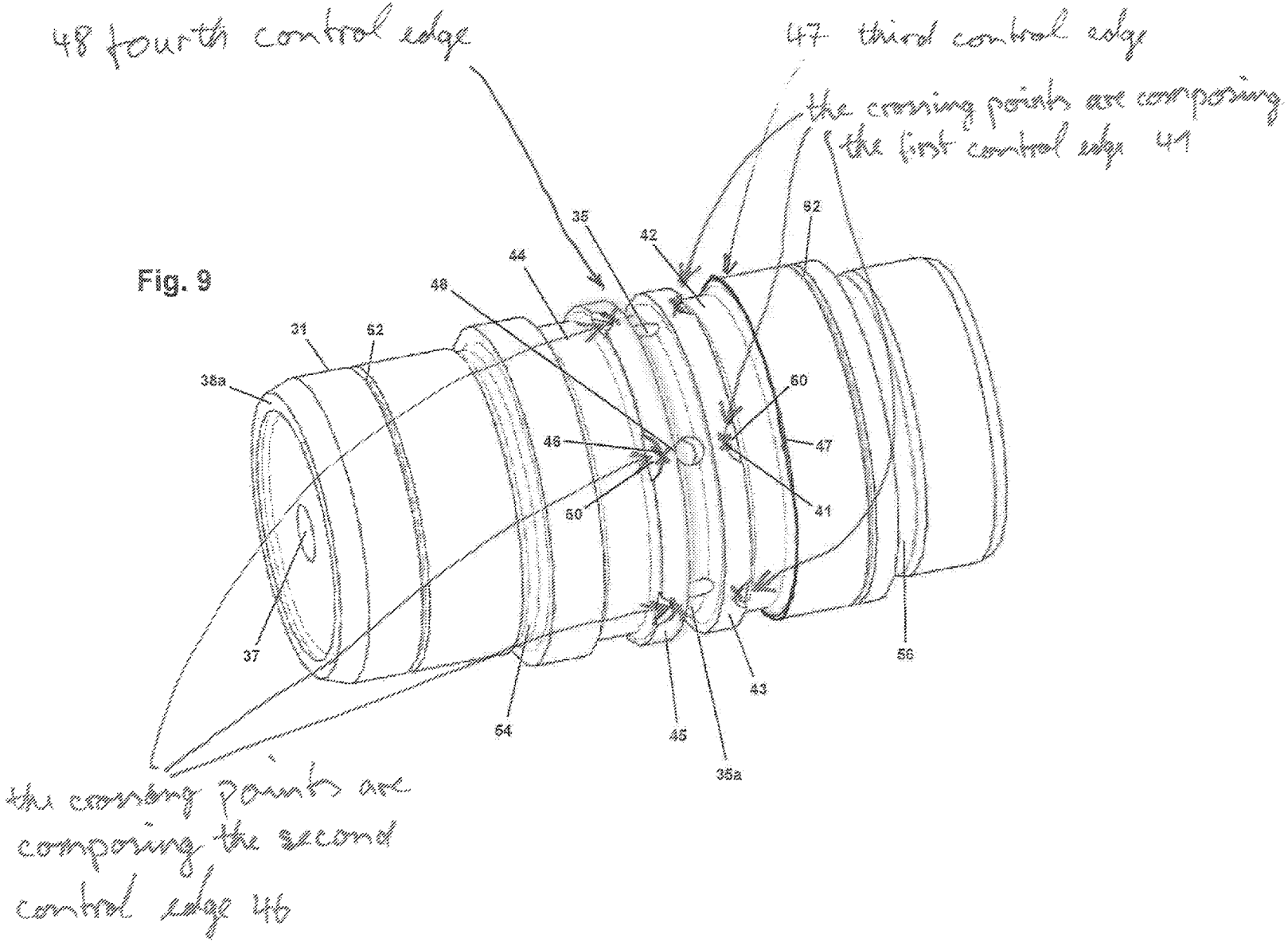
FIG. 9: a perspective view of the control piston.

A further outer radial groove 62 is preferably applied to the outer jacket of the control piston 31 and is located on a web disposed next to the high pressure groove 52 and extends over the total periphery of the control piston 31 (cf. FIG. 9). Alternatively or additionally, a further outer radial groove 62 that extends over the total periphery of the control piston 31 (cf. FIG. 9) is located on the outer jacket of the control piston 31 along the longitudinal section extending from the control pressure groove 54 up to the piston end 38. The sense and purpose of these two optional relief grooves 62 is the avoidance of a respective pressure drop along the periphery of the control piston 31.

The feedback spring 33 exerts a force on the control piston 31 that acts in the direction of the closed housing end of the control valve 30. In this process, this force increases as the pivot angle of the swash plate 6 increases or respectively with the position of the setting level 21 and of the setting piston 22 respectively accompanying it.

The embodiment of FIG. 3 shows a control valve 30 that is hydraulically controlled. For this purpose, an externally generated control pressure is conducted for this purpose via a control pressure connection ST up to the control piston 31 where it impacts a control pressure groove 54 configured as an outer radial groove of the control piston 31. The control pressure groove 54 forms together with an annular space 40 present between the control piston 31 and the valve housing 32 a chamber whose volume depends on the axial position of the control piston 31 and that can also be called a control pressure chamber. Outside the annular space 40, where the control pressure bore ST impacts the control piston 31, the outer diameter and thus the cross-sectional surface of the control piston 31 on the side facing the setting piston 22 is greater than on the other side so that the control pressure applied to the control surface formed by the control pressure chamber 40, 54 exerts—as intended—a force on the control piston 31 that counteracts the return force of the feedback spring 33.

Since the oil connection present for the transfer of the setting pressure from the control valve 30 to the adjustment chamber 34 in the embodiment is led away from the control piston 31 in the axial direction, the latter has a first active surface that is directed such that the applied setting pressure (that is the pressure present in the spring chamber 33*a*) exerts a force on the control piston 31 acting in the direction of the blind hole base of the bore 31*a*. This first active surface is composed of the surface of the blind hole base of the hollow space 33*a* of the control piston 31, i.e. of the pot base and the area of the jacket wall of the control piston 31 at its end facing the adjustment chamber 34, where the setting pressure is likewise applied. The following is provided so that on its functional exertion in such a control valve 30 there is an exact compensation of this force (that is the setting pressure is compensated on both sides of the control piston 31) and on the production of such a control valve 30 the control piston 31 can be inserted into the valve housing 32:

The control valve 30 or the control piston 31 respectively is modified such that (I) there is a second active surface for the setting pressure that is directed such that the applied setting pressure exerts a force on the control piston 31 that acts in the direction of the setting piston 22; and (ii) these two first and second active surfaces that are so-to-say directed against one another each have an area of equal size so that the oppositely acting forces cancel one another out.

In the embodiment, there is a continuous bore 37 at the blind hole base of the spring chamber 33*a* of the control piston 31 and the control piston 31 furthermore has an outer diameter of the same size at its two end sections. The latter is made possible in that the control piston 31 has a correspondingly tapered outer diameter at its end section facing the setting piston 22. In turn the section of the piston bore 31*a* facing the setting piston 22 in the valve housing 32 has a larger diameter. On the assembly of such a control valve 30, the annular intermediate space remaining due to these two said cutouts after the pushing of the control piston 31 into the valve housing 32 is closed by a geometrically adapted ring 39. The ring 39 serves as a contact surface of the control piston 31 and contributes to a good piston guidance. The ring 39 moreover avoids an appreciable oil pressure being applied from the smaller to the larger outer diameter at the step of the jacket surface of the control piston 31. Small oil amounts that pass through the gap between the control piston 31 and the ring 39—and that are desired for the maintenance of a lubrication film there—or through the gap between the wall of the piston bore 31*a* and the ring 39 in the transverse direction are led off via the leak groove 56 and the leak bore L.

The ring 39 used can be fixed by shaft securing ring 39*a*. The surface regions at which the ring 39 and the control piston 31 contact one another have to be adapted to one another such that, on the one hand, a sufficient leak of hydraulic oil under setting pressure into the tank return L is present so that the required lubrication film also remains in the case of low setting pressures. On the other hand, the leak should self-evidently not be unnecessarily high.

The ring 39 can furthermore form an axial end abutment of the control piston 31 that bounds a displacement of the control piston 31 in the direction of the setting piston 22. The other end position of the control piston 31 is defined by the base of the bore 31*a*. It can have a depression, as shown in FIG. 3. It can hereby be avoided that the total base of the blind hole bore 31*a* and the total front side 38 of the control piston 31 oriented thereon has to be produced correspondingly precisely to achieve an exact abutment, but the abutment is rather only formed by respective projecting part regions of the blind hole base disposed exactly opposite one another and at the front side 38 and only they therefore have to be worked with the increased precision, whereas a large part of those surface regions can be designed without increased precision, which produces a reduction of the manufacturing costs. For this purpose, as is shown in FIG. 9, the front side 38 of the control piston can have an annular projection 38*a* on the side remote from the setting piston 22, said projection 38*a* forming the abutment for the base of the housing bore 31*a* and having the previously addressed increased precision.

The axial bore 37 can have a constriction, as shown in the embodiment in accordance with FIG. 3. A defined restrictive effect can thereby deliberately be achieved in this oil connection to suppress pressure pulsations, for example.

The control piston 31 is guided along at least four longitudinal sections at the inner walls of its bore 31 accommodating it in the valve housing 32. They are, starting from the end facing the setting piston 22:

- longitudinal section I; inner wall of the ring 39;
- Longitudinal section intermediate space between the leak bore L and the high pressure bore A;
- Longitudinal section III.; intermediate space between the low pressure bore T and the control pressure bore ST; and
- Longitudinal section IV; intermediate space between the control pressure chamber 40, 54 and the end abutment position of the control piston 31, i.e. the base of the housing bore 31*a*.

The control piston 31 shown in the embodiment has a relatively long cylindrical longitudinal section (between the front side 38 and the control pressure groove 54) with an unchanging outer diameter at its end remote from the setting piston 22. The piston guidance in the housing bore 31*a* is improved by such an additional jacket surface section that is free of radial grooves—apart from possibly required split ring seals or a relief groove 62 that, as is known, each have a very small width. The wall section of the housing bore 31*a* that serves as a contact surface for this end section is likewise worked purely cylindrically with an unchanging diameter. This sweeping extent of this longitudinal section IV contributes to an exact guidance of the control piston 31. This is advantageous since the tendency toward tilt movements of the control piston 31 cannot be sufficiently suppressed by an insufficient piston guidance. As a consequence of this, the opening widths of the control edges 41, 46, 47, 48 would not be solely dependent on the axial piston position, which would hugely degrade the precision of a control or regulation; this applies equally to a hysteresis that could be present by the possible canting of the control piston 31 in its piston guide 31*a*.

A further reason for the comparatively large extent of the longitudinal section IV in the embodiment is the necessity that the pressure of the leak oil that flows off between the walls of the control piston 31 and the piston bore 31*a* into the annular space 40 degrades along the lead path to prevent an increased application of pressure on the control surface provided for the control pressure in the event of a small control pressure supplied from the outside due to the leak oil. At the start of the leak path observed here, the leak oil has the pressure level of the setting pressure.

The arrangements of the control edges 41, 46, 47, 48 of the control valve 30 in accordance with the invention in accordance with the first aspect of the invention are important for its function. FIGS. 4 to 9 serve to show the operation and arrangement of these control edges 41, 46, 47, 48 in detail. FIGS. 4 to 8 are detail views that each show a section through the control piston 31 and the valve housing 32 in the near zone of the setting pressure bore 35, with the control piston moving further and further from right to left, that is away from the setting piston 22, as the Figure number increases. The major axial positions of the control piston 31 have been shown by these illustrations. A higher ranking orientation of the effect of the control edge states shown in the following results from FIG. 3. FIG. 9 shows the control piston from the outside in a perspective view, with the relative arrangement of the control edges 41, 46, 47, 48, relief grooves 62, and webs 43, 45 becoming considerably visible, just like their shape-related designs.

It must be noted at this point that strictly speaking the combination of an edge of the control piston 31 and an associated edge of the surrounding housing 32 forms the actual control edge. For reasons of simplicity, however, the term "control edge" is used for the corresponding edge of the control piston 31 in the present text.

The control piston 31 in the embodiment treated here has four control edges 41, 46, 47, 48 of which a first control edge 41 and a second control edge 46 serve as main control edges that control the hydraulic fluid flow in regulation operation of the control valve 30. For this purpose, depending on the axial position of the control piston 31, a fluid connection can be controlled or opened and closed between the setting pressure connection (or setting pressure bore(s) 35)—and thus the setting pressure chamber 34—and the high pressure connection A via the first control edge 41 and a fluid connection between the setting pressure connection and the lower pressure connection T can be controlled or opened and closed via the second control edge 46. A third control edge 47 and a fourth control edge 48 serve the provision of a functionality of the control piston 31 in emergency operation in which there is no application of an externally provided control pressure on the control pressure chamber 40, 54. In the latter case, the control piston is located at its left (with reference to FIGS. 4-8) end abutment.

The control piston 31 therefore has a total of four control edges that are formed at three webs. The following illustrations relate to an application example of the control valve 30 in accordance with FIG. 3.

Figure 4:
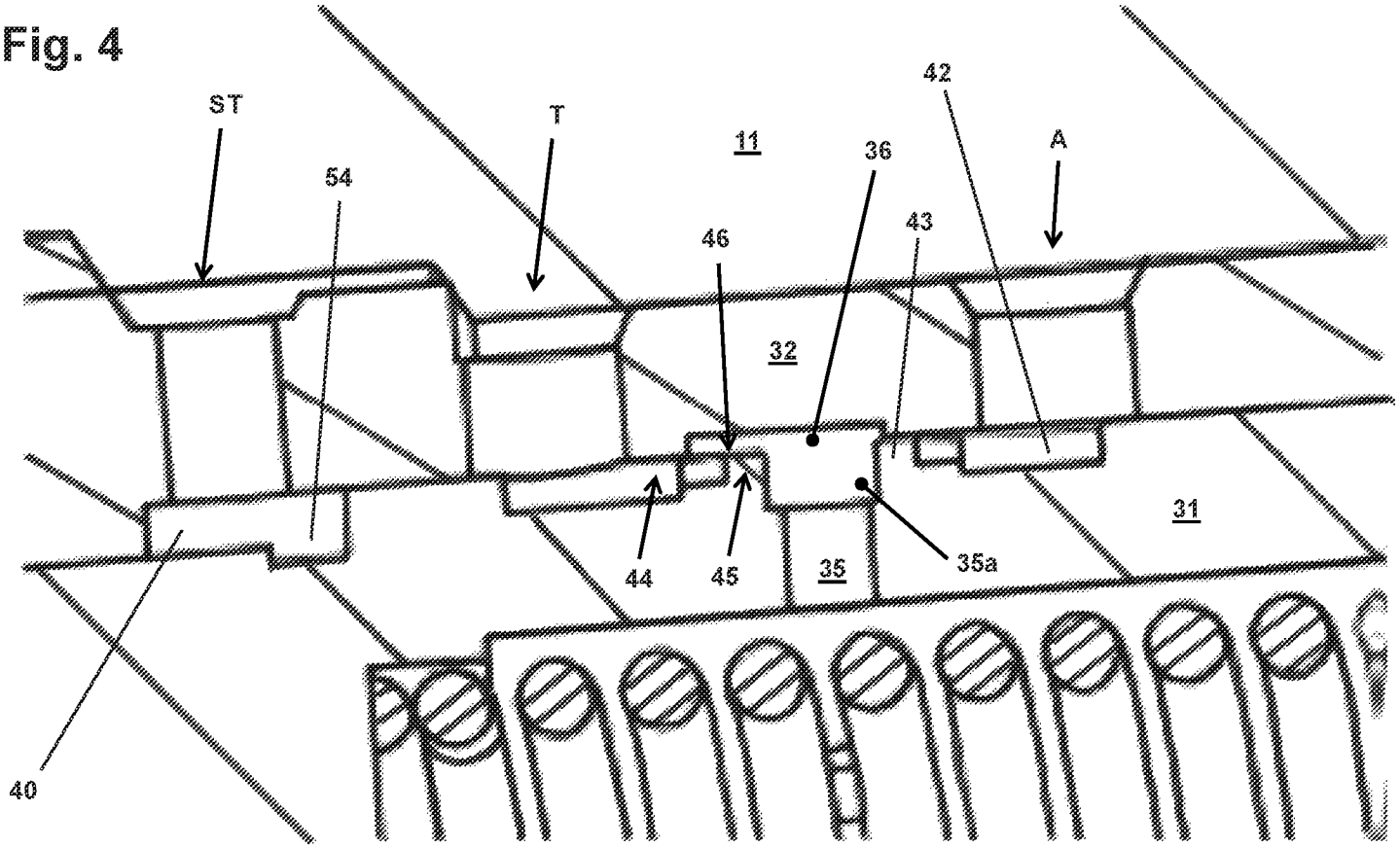
FIG. 4: a detail view of a control valve section to illustrate the control edges with an open second control edge between the low pressure inlet and the setting pressure bore.

Starting from a stationary state in regulation operation in which the setting piston 22 remains outside of an end position in otherwise any desired position, an increase in the control pressure results in a displacement of the control piston 31 to the right in the direction of the setting piston 22. This piston position is shown in FIG. 4. The second control edge 46 that is formed by the web 45 disposed between the setting pressure groove 35*a* and the low pressure groove 44 (cf. also FIG. 9) hereby opens. When the control edge 46 is open, there is an oil connection between the low pressure inlet T and the adjustment chamber 34 via the low pressure groove 44, the connection groove 36, the setting pressure groove 35*a*, the setting pressure bore(s) 35, and the spring chamber 33*a*. The oil connection between the high pressure inlet A and the setting pressure connection is simultaneously closed by the first control edge 41 that is formed by the web 43 disposed between the setting pressure groove 35*a* and the high pressure groove 42 (cf. also FIG. 9).

Figure 5:
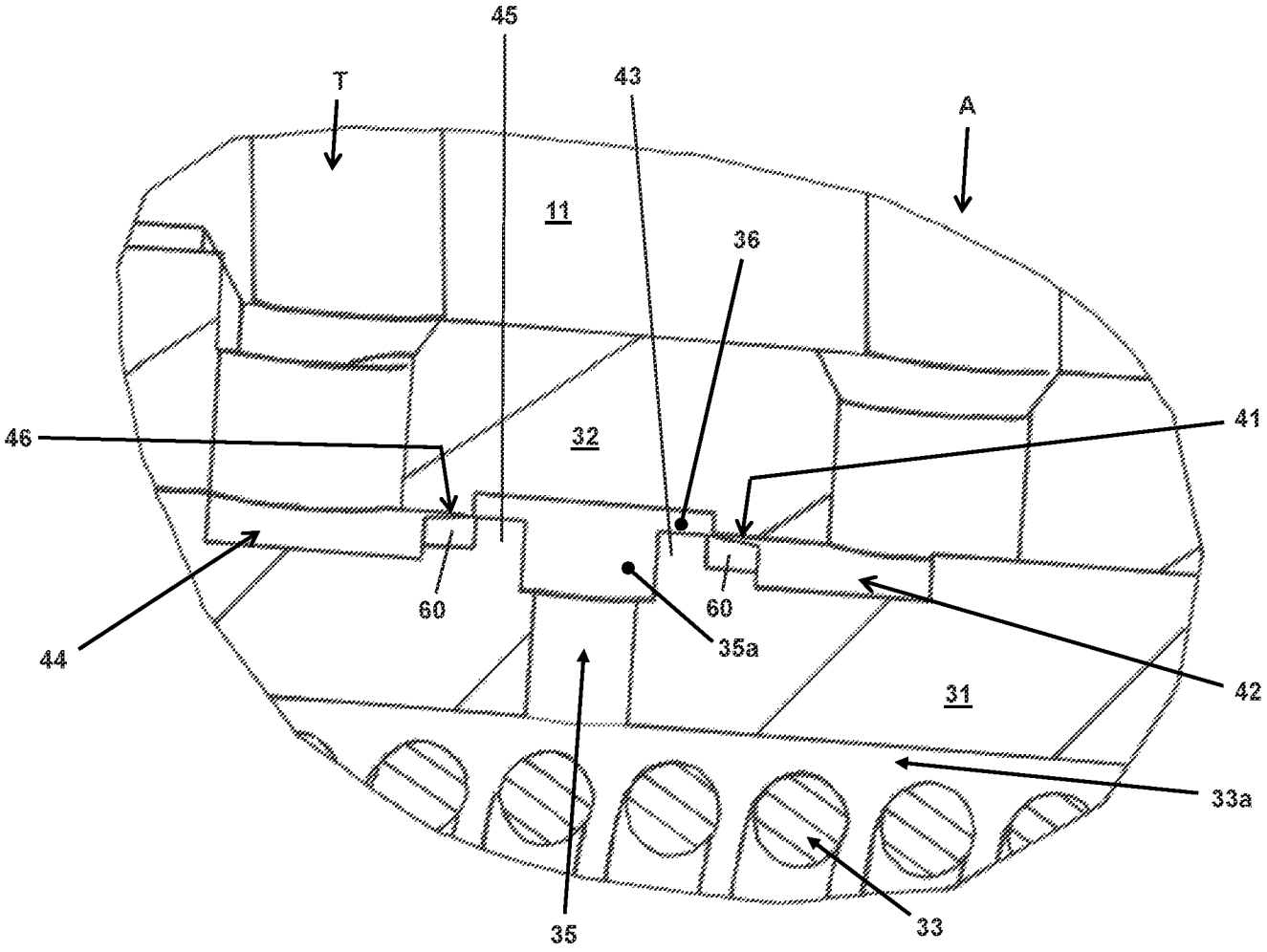
FIG. 5: the detail view in accordance with FIG. 4 in the stationary state during regulation operation.

FIG. 5 shows the piston position of the control piston 31 in regulation operation on the presence of a stationary state of the adjustment device 20. In this state, there is neither an oil connection between the setting pressure chamber 34 and the high pressure inlet A via the control pressure bore 35 nor is there an oil connection between the setting pressure chamber 34 and the low pressure inlet T via the control pressure bore 35. Accordingly, both the first control edge 41 and the second control edge 46 are closed. In a period in which both these control edges 41, 46 are closed, the axial piston pump is operated with an unchanging pivot angle/driving mechanism stroke/conveying volume.

Figure 6:
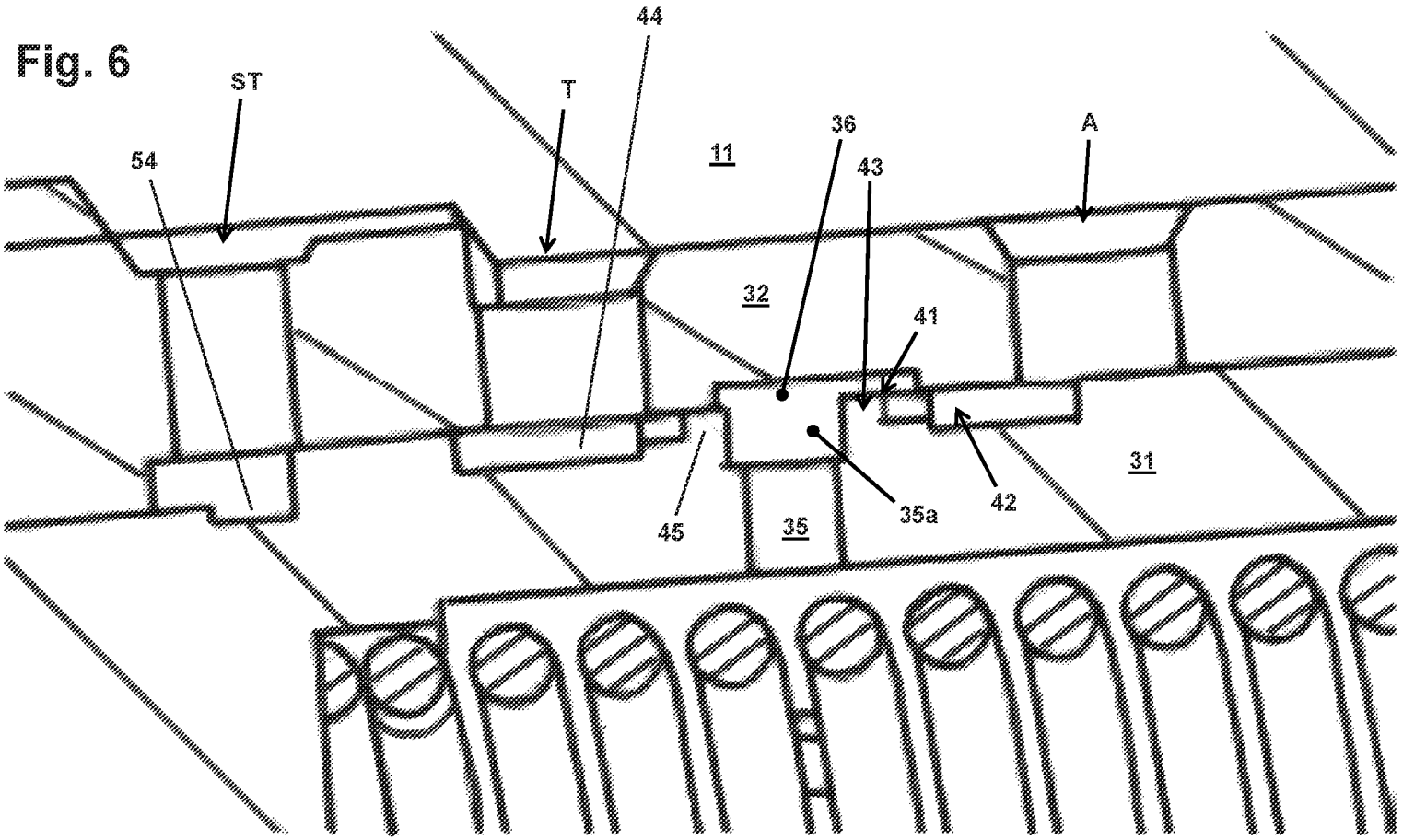
FIG. 6: the detail view in accordance with FIG. 4 with an open first control edge between the high pressure inlet and the setting pressure bore.

Starting from a stationary state in regulation operation in which the setting piston 22 remains outside of an end position in otherwise any desired position, a reduction in the control pressure results in a displacement of the control piston 31 to the left in the direction of the blind hole base of the housing bore 31*a*. This piston position is shown in FIG. 6. The first control edge 41 hereby opens so that there is an oil connection between the high pressure inlet A and the adjustment chamber 34 via the high pressure groove 42, the connection groove 36, the setting pressure groove 35*a*, the setting pressure bore(s) 35, and the spring chamber 33*a*. The oil connection between the low pressure inlet T and the setting pressure connection is simultaneously closed by the second control edge 46.

In the application example in accordance with FIG. 2, the level of the control pressure acting on the control piston 31 is specified or co-determined by an electrically actuated actuator. It is specifically a pressure reducing unit 50 that is controlled by a proportional magnet and that derives a control pressure from the high pressure from the work outlet A of the axial piston pump provided to it. It can already be recognized from the circuit diagram of FIG. 2 that on the failure of the magnetization current, the oil resupply for maintaining the control pressure is interrupted. The control pressure then drops after a short time to a relative value of 0 bar due to leakage. As mentioned, a reduction of the control pressure results in a displacement of the control piston 31 in the direction of the blind hole base of the housing bore 31*a*. On the presence of a relative control pressure of 0 bar, the control piston 31 reaches its abutment position there.

The control valve 30 in accordance with the invention distinguishes itself by the cooperation of a special feature of this abutment position and the property caused by the design to provide a comparatively large flow cross-section between the setting pressure groove 35*a* and the adjustment chamber 34. During the displacement of the control piston 31 (in the direction of the blind hole base of the housing bore 31*a*) in this abutment position, it passes through two striking instantaneous positions that are shown in FIGS. 7 and 8.

Figure 7:
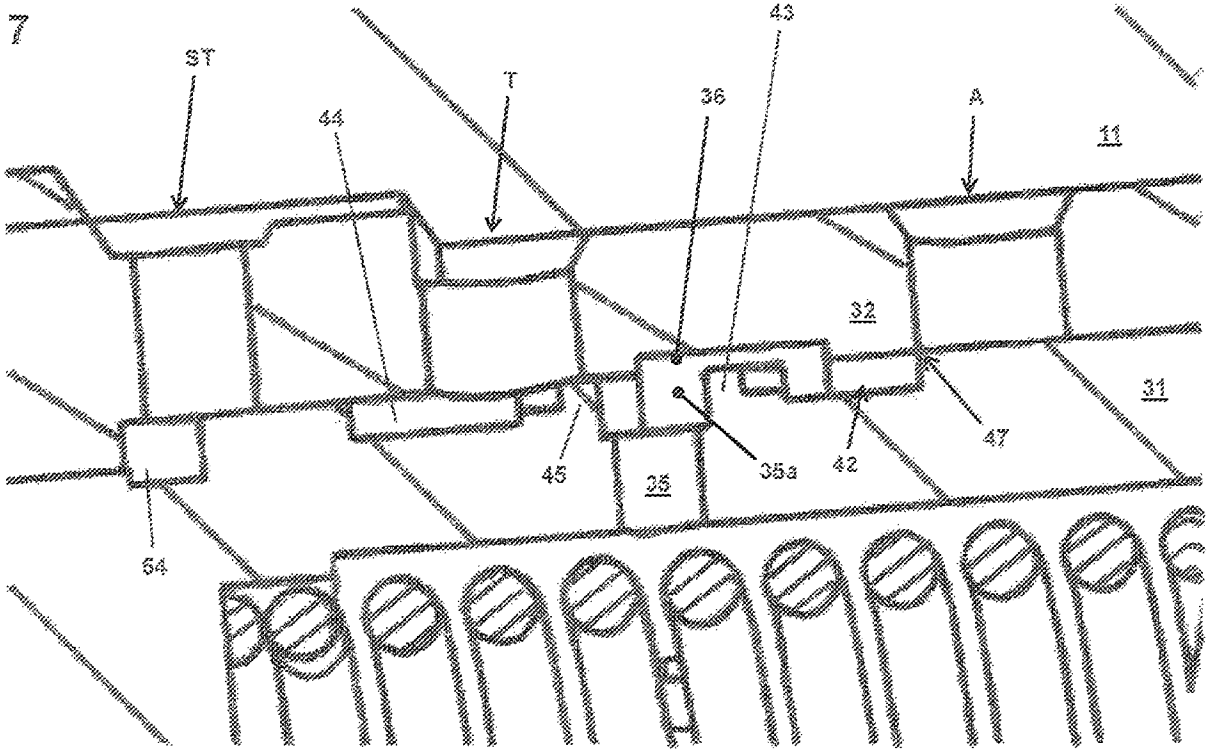
FIG. 7: the detail view in accordance with FIG. 4 in transition operation to the safety function or emergency function on the closing of the third control edge.

FIG. 7 shows the first of these two instantaneous positions passed through in the already used manner of the detail representations. And a third control edge 47 admittedly closes in this instantaneous position that is formed by the groove wall of the high pressure groove 42 disposed opposite the control edge 41 (cf. also FIG. 9), which effects an interruption of the oil connection between the high pressure inlet A and the adjustment chamber 34. This control edge 47 remains closed on the further movement of the control piston 31 to the left in the direction of its abutment position and also on its reaching.

Figure 8:
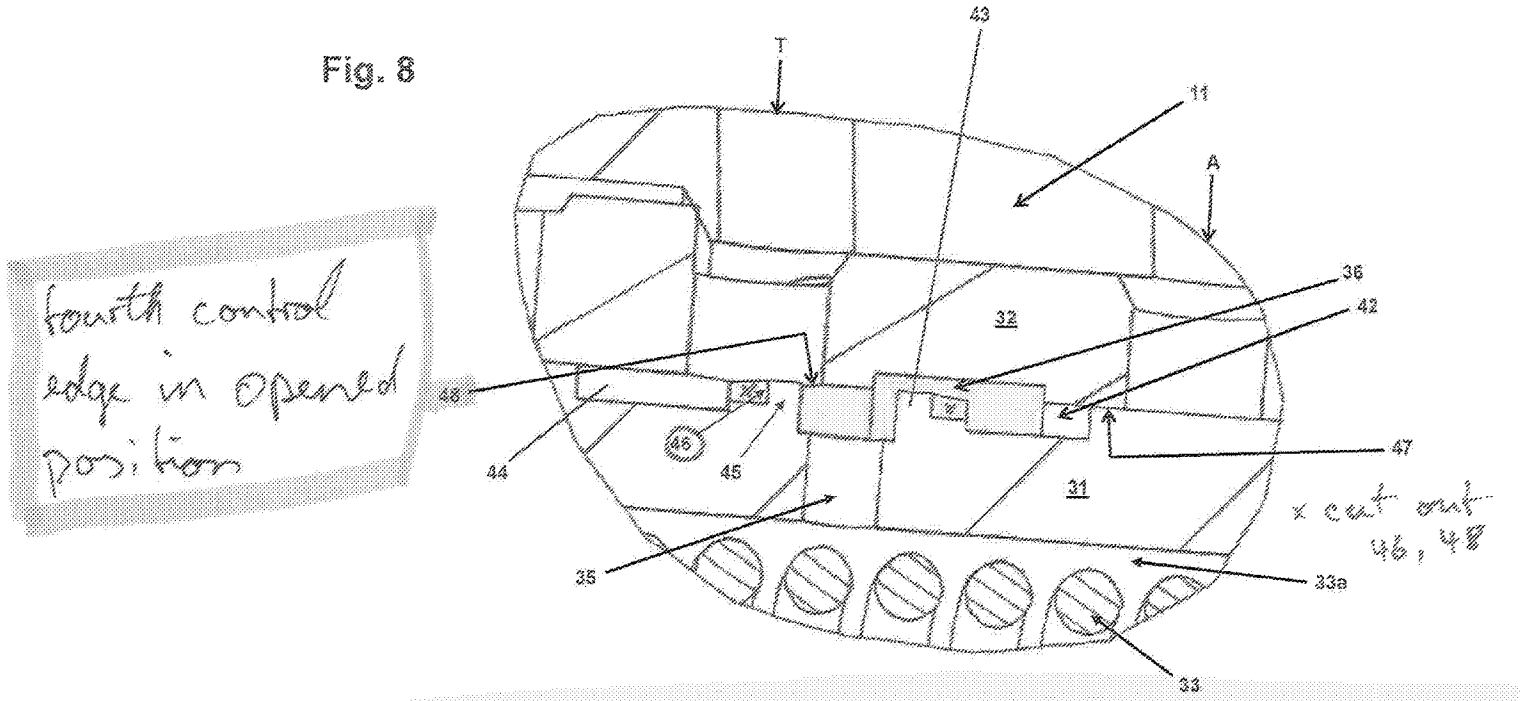
FIG. 8: the detail view in accordance with FIG. 4 in operation with the safety function or emergency function with an open fourth control edge.

FIG. 8 shows the second striking instantaneous position of the control piston 31 that is passed through later than the first striking instantaneous position (on a displacement of the control piston 31 taking place in the direction of the blind hole base of the housing bore 31*a*). In this process, a fourth control edge 48 opens, which results in an opening of a direct oil connection between the low pressure inlet T and the adjustment chamber 34 without using or flowing through the low pressure groove 44. This fourth control edge 48 remains open on the further movement of the control piston 31 to the left in the direction of its end position and also on its reaching. FIG. 8 shows the near zone of the control edges 41, 46, 47, 48 in a detail view when the control piston 31 has adopted its abutment position at the blind hole base of the bore 31*a*. The opened fourth control edge 48, that is formed by the side of the web 45 disposed opposite the second control edge 46, can be easily recognized.

The third and fourth control edges 47, 48 are not used for controlling at all in normal operation and are only used/switched once per transition into the abutment position provided for a safety function or emergency function. These control edges 47, 48 are therefore preferably designed such that the production effect is as low as possible Since the third and fourth control edges 47, 48 are also arranged in the main fluid flow in regulation operation, i.e. are also exposed to the fluid flow flowing in normal operation, no deposits can form or no other problems can occur that can be accompanied by a longer non-use of fluid channels or control edges.

On the closing procedure of the third control edge 47, the overlapping opening cross-section between the high pressure inlet A in the housing 32 and the high pressure groove 42 first reduces. No measure is taken at the control piston 31 that has the effect that there is a gentle transition on the transition from the still open third control edge 47 to the already closed third control edge 47. With a just still open third control edge 47, a remaining opening cross-section is present between the high pressure inlet A and the high pressure groove 42 along its total periphery that is so-to-say interrupted at a single moment with a just closing control edge 47.

On an opening procedure of the fourth control edge 48, the same circumstance applies in a reverse order. At the moment of the opening of the fourth control edge 48 between the low pressure inlet T and the low pressure groove 44, the opening cross-section is exposed along its total periphery.

As regards the changing flow cross-sections on the opening and closing of control edges of the valve housing 32, it is in each case a part area of a circle or a plurality of part areas of a plurality of circles, and indeed because the oil connections are guided to the control piston 31 via cylindrical bores through the valve housing 32. Such a geometry softens the transition between a control edge opening or closing as part of the movement of the control piston 31. As regards the changing flow cross-sections on the opening and closing of control edges of the control piston 31, in contrast, it is a transfer of the circumstances to an area in each case around a rectangle if no measures have been taken at the control piston 31 with respect to the control edge design that have a contribution to achieving a precise regulation or control.

Such a contribution can be achieved by an avoidance of a control edge already being moved from a (practically) complete opening into a (practically) complete closing on a very small movement of the control piston 31. Instead a comparatively large position change of the control piston 31 should effect a comparatively small change of the opening cross-section in the transition region.

To improve the suitability of the control valve 30 with respect to the design of the first control edge 47 for controls and regulations, counterbores 60 are positioned in the web 43 such that the cutouts produced via these counterbores 60 form a common volume with the high pressure groove 42 and simultaneously result in a local shortening of the web width of the web 43, i.e. of the web between the high pressure groove 42 and the setting pressure groove 35*a*. To improve the suitability of the second control edge 46 for controls and regulations, counterbores 60 are positioned in an analog manner such that the cutouts produced via these counterbores 60 form a common volume with the low pressure groove 44 and simultaneously result in a local shortening of the web width of the web 45, i.e. of the web between the low pressure groove 44 and the setting pressure groove 35*a*.

These counterbores 60 can be easily recognized in FIG. 9, with two respective cutouts at adjacent webs 43, 45 being associated with each setting pressure bore 35. Instead of a circular shape, different forms can also be used, for example (viewed from above), a trapezoidal, triangular, ellipsoid, or otherwise conical shape, with the width of the cutout 60 reducing toward the setting pressure groove 35*a*. It is furthermore conceivable that the centers of the cutouts 60 are not disposed on a line with the center of the associated setting pressure bore 35 as in FIG. 9, but rather laterally offset therefrom. Unlike the embodiment of FIG. 9 in which the counterbores 60 have a smaller depth than the low pressure or high pressure groove 42, 44, provision can also be made that the counterbores 60 have the same depth or a larger depth. The bases of the counterbores can furthermore be chamfered.

In FIG. 9, two relief grooves 62 formed as outer radial grooves completely peripheral around the control piston 31 and having a reduced width in comparison with the high pressure and low pressure grooves 42, 44 can be recognized. An annular overhang or projection 38*a* at the front side 38 of the control piston 31, as already mentioned for the reduction of the surface to be produced with increased precision is also recognizable.

The construction in accordance with the invention is not limited by the fact that the hollow space 33*a* in the control piston 31 and the adjustment chamber 34 are directly adjacent one another. The construction in accordance with the invention is likewise not limited by the fact that the feedback spring 32 projects into the hollow space 33*a* of the control piston 31. The construction in accordance with the invention is also not restricted to control or regulation valves 30 that are installed in the housing 8 or in the connection plate 11 of the axial piston machine, but can rather also be applied to control and regulation valves 30 that are installed outside an axial piston machine.

In addition, an application of the construction in accordance with the invention to such control or regulation valves 30 is possible in which the input signal, for example in the form of an externally produced force, is directly applied to the front side 38 of the control piston 31 remote from the feedback spring 33, for example via a plunger actuated by a proportional magnet or an actuator motor.

One of the advantages of the control valve 30 in accordance with the invention over the prior art comprises the physical oil connections being practically identical in the case of an existing oil connection between the low pressure inlet T and the adjustment chamber 34 in regulation operation and in emergency operation and the total surface regions of the control piston 31 and the total surface regions of the valve housing 32 that form the wall of the hydraulic oil main flow path present here on the start of emergency operation, also in particular include the wall areas of the third control edge 47 and the fourth control edge 48 and are already exposed to an oil flow during regulation operation. In contrast, with known control valves that enable a comparable safety function, comparatively extensive oil connections that are no longer flowed through by hydraulic oil since the installation of the control valve are used as a rule in the case of their activation. Accordingly, on an occurrence of a corresponding defect, for example a cable break, a comparatively long hydraulic oil flow path has to be instantaneously functional that may no longer have been flowed through by hydraulic oil for some years, which represents a risk that may not be underestimated that the safety function is ultimately not available.

The provision of a safety function or emergency function is not only possible by means of a control valve such as was shown in FIGS. 2-9 and corresponds to a first aspect of the present invention. In accordance with a second aspect of the invention, a control valve of the category, that is without the at least one further control edge, can likewise satisfy such functions in combination with a further valve 53 connected upstream of the control pressure connection ST of the control valve 30, as is shown as a circuit diagram for an embodiment in FIG. 10.

Figure 10:
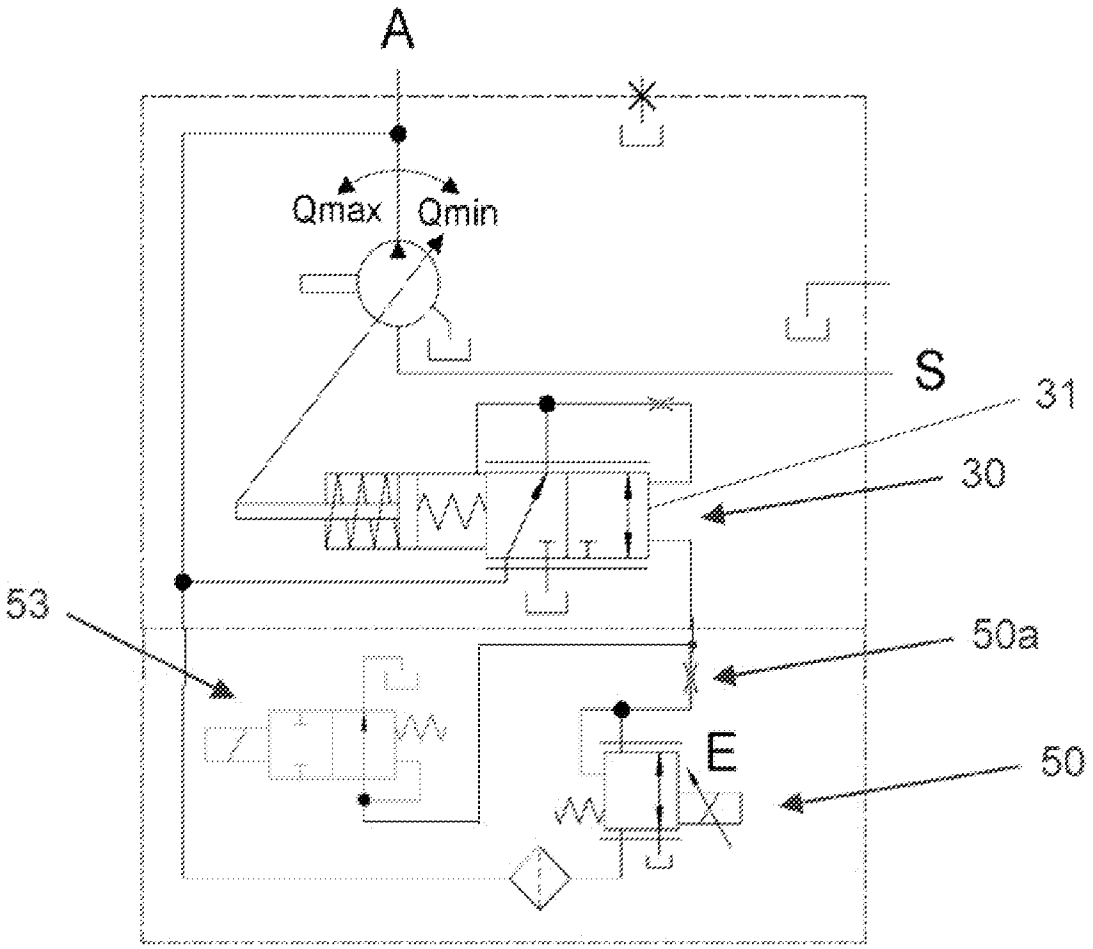
FIG. 10: a circuit diagram of a hydraulic device in accordance with the invention that has an emergency function having a control valve in accordance with the second aspect of the invention.

FIG. 10 shows a volume flow regulation/control of an axial piston pump that unlike FIG. 2 does not include any control valve 30 having a third or fourth control edge 47, 48, but rather a control valve 30 of the category (it can have the main control edges 41 and 46 as previously described). The oil filter shown here and connected upstream of the pressure reducing unit 50 is generally used in a comparable apparatus, but is only optionally present. The circuit diagram furthermore does not show any pressure cutoff 51 and no load sensing unit 52. As mentioned, one or both of these valves can optionally be included in an apparatus in accordance with the invention.

In addition to the circuit diagram of FIG. 2, the circuit diagram shown in FIG. 10 includes an electrically controlled 2/2 way valve 53 that in turn has a fluid connection to the fluid connection that is present between the pressure reducing unit 50 and the control valve 30 and in which the control pressure produced by the pressure reducing unit 50 is present in regulation operation. If the electrical actuator associated with the 2/2 way vale 53 is energized, it is in blocking operation and therefore in turn does not exert any influence on the position of the control piston 31 or on the operation of the axial piston machine.

On a failure or a deliberate shutdown of that electrical actuator, the 2/2 way valve 53 has the switch position shown in FIG. 10 and therefore conducts an oil flow that is discharged from the pressure reducing unit 50 and that would result in the formation of a control pressure for the control valve 30 into the tank return line. As should be emphasized by the additionally entered restrictor 50*a*, a substantially larger oil flow can be conducted back to the hydraulic oil storage tank via the 2/2 way valve than is provided by the pressure reducing unit 50. Consequently, a control pressure of so-to-say 0 bar (relative) is supplied to the control valve 30 so that the control piston 31 of the control valve 30 in such a case would adopt the switched position shown. In such a case, the axial piston pump will carry out a conveying of the maximum volume flow at the respectively present speed, which corresponds to the previously already described safety function.

So that an emergency function is also made possible with such an apparatus, that is in particular in such applications in which a safe operating state is present in an error case when the axial piston machine so-to-say no longer convey any volume flow, the arrangement in accordance with FIG. 10 can be modified such that the corresponding connection of the 2/2 way valve 53 is not equipped with a tank return line, but rather has a fluid connection to a hydraulic high pressure source, for example at the work output of an auxiliary hydraulic pump. If a corresponding pressure level can be provided, a pressure level naturally does not have to be supplied for this purpose at which the valve piston 31 of the control valve 30 adopts its end position, a pressure level can rather be used at which the axial piston machine works in accordance with a preferred speed/volume flow characteristic in emergency operation.

A valve is preferably used as the 2/2 way valve 53 that only has the switched positions open and closed since this is less expensive and more robust in principle due to the simple design.

In addition to an electrical functional failure of a hydraulic unit that is electrically controlled and that generates a pressure signal or a control pressure in dependence thereon, such as the pressure reducing unit 50 of FIG. 10, a functional failure of such a unit can also take place by a hydraulically mechanical defect, for example by the seizing of a valve piston("piston seizure") of the hydraulic unit via which the control pressure supplied to the control valve 30 is set.

On the presence of such a hydraulically mechanical defect, the control pressure supplied to the control valve 30 does not have a value of incorrectly 0 bar (relative), but rather a value that is random with respect to the desired behavior and that differs from that pressure value that would be present in the case of a functioning unit.

If such a defect occurs, the electrical actuator associated with the 2/2 way valve 53 can be shut down, whereby—depending on whether the 2/2 way valve 53 is connected at said connection to the tank return or to a high pressure source—the tank pressure level or a different pressure level is supplied to the control pressure inlet ST A safety function or an emergency function can be implemented in this manner that also intervenes on a mechanically hydraulic defect of the pressure reducing unit 50.

Using a control valve 30 in accordance with the invention in accordance with the first aspect of the invention in interaction with the possibility of being able to supply a variable pressure level to the low pressure inlet T of the control valve 30, a synergy can be formed while including said addition by the 2/2 way valve 53. For with such an arrangement, an emergency function going beyond the functional extent of the safety function cannot only be achieved on a failure of the electrical actuator of the pressure reducing unit 50 (for example on a cable break), but also on a mechanically hydraulic defect (e.g. piston seizure) of the pressure reducing unit 50 or a hydraulic unit comparable in its function.

At least one monitoring of the pressure level present at the control pressure inlet ST preferably takes place via which a corresponding mechanically hydraulic defect can be determined. Such a monitoring particularly preferably takes place by means of a pressure measurement along the oil connection for the control pressure (not drawn in FIG. 10) and a corresponding comparison with at least one desired value for the control pressure. The recognition of a hydraulically mechanical defect preferably triggers a corresponding control of the 2/2 way valve 53 that activates the bringing into effect of the safety function or emergency function.

The used 2/2 way valve 53 could optionally be distinguished in that the safety function or emergency function is triggered while energizing its electrical actuator, which can, however, be disadvantageous, in particular under the aspect that on a defect of the electrics/electronics, both electrical actuators (that is also the one of the pressure reducing unit 50) can be affected thereby.

Ultimately, functions of the control valve 30 in accordance with the second aspect of the invention are achieved in that the control pressure supplied to the control valve 30 is set by an additional apparatus to the tank pressure level (safety function) or to a sufficient or preferred high pressure level (emergency function).

Figure 11:
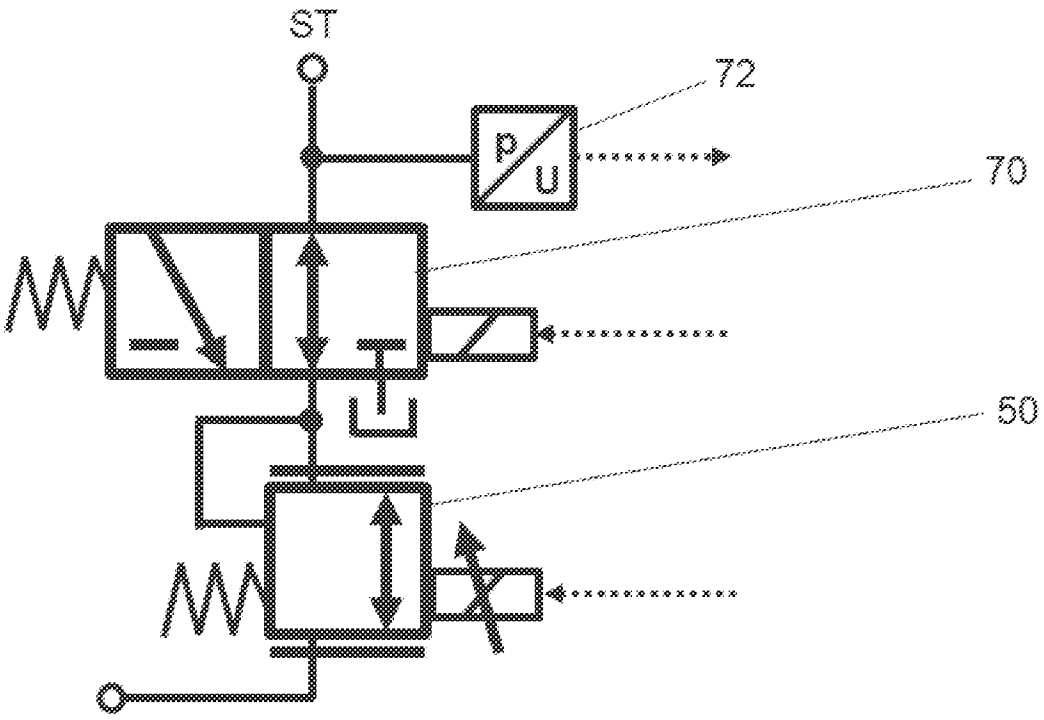
FIG. 11 a circuit diagram of a 3/2 way valve that is connected downstream of the pressure reducing unit and that can be used alternatively to the 2/2 way valve of FIG. 10.

FIG. 11 shows a 3/2 way valve 70 that could be used correspondingly "fluidically" in the apparatus in accordance with the invention in accordance with FIG. 10 instead of the 2/2 way valve. An example for a pressure monitoring device 72 is likewise drawn in this respect.

REFERENCE NUMERAL LIST

1 drive shaft
2 driving mechanism
3 driving mechanism piston
4 cylinder bore
5 sliding block
6 swash plate
7 return spring
8 housing
9 retraction ball
10 retraction plate
11 connection plate
11*a* blind hole bore
12 central spring
13 control plate
20 adjusting device
21 setting lever
22 setting piston
23 overhang
30 control valve
31 control piston
31*a* bore
32 valve housing
33 feedback spring
33*a* hollow space (spring chamber)
34 adjustment chamber
35 setting pressure bore
35*a* setting pressure groove
36 connection groove
37 axial bore
38 front side
38*a* annular projection
39 ring
39*a* shaft securing ring
40 annular space
41 first control edge

42 high pressure groove
43 web
44 low pressure groove
45 web
46 second control edge
47 third control edge
48 fourth control edge
50 pressure producing unit
50*a* restrictor
51 pressure cutoff (DA)
52 load sensing stage (LS)
53 valve (2/2 way valve)
54 control pressure groove
56 leak groove
60 cutout
62 relief valve
70 3/2 way valve
72 pressure monitoring device
A high pressure inlet
E control signal
L leak connection
S suction connection
ST control pressure inlet
T low pressure inlet
$Q_{min}$ minimal conveying flow
$Q_{max}$ maximum conveying flow

The invention claimed is:

1. An axial piston machine comprising a pivotably supported swash plate (6), a rotatably supported drive shaft (1), a driving mechanism (2) rotationally fixedly connected to the drive shaft (1), one or more driving mechanism pistons (3) received in the driving mechanism (2), which are axially displaceably supported, and whose piston stroke is settable by the swash plate (6), a mechanical adjustment device (20) for changing the pivot angle of the swash plate (6), and an externally controllable control valve (30), wherein the control valve (30) has a valve housing (32) having a control piston (31) displaceably supported in a bore (31*a*), the adjustment device (20) is hydraulically actuable by the control valve (30), an adjustment chamber (34) of the control valve (30) for a hydraulic pressure action on the adjustment device (20) is connectable, in dependence on a switched state of the control valve (30), to a high pressure inlet (A) or to a low pressure inlet (T) of the control valve (30) via a setting pressure connection extending radially through the control piston (31), and during operation with an active external control of the control valve (30), a fluid connection between the high pressure inlet (A) and the setting pressure connection is established via a first control edge (41) or a fluid connection between the low pressure inlet (T) and the setting pressure connection is established via a second control edge (46), wherein a third control edge and a fourth control edge (47, 48) are provided that are configured such that in an emergency operation without an active external control of the control valve, a fluid connection is established via the fourth control edge (48) between the low pressure inlet (T) and the setting pressure connection after a fluid connection between the high pressure inlet (A) and the setting pressure connection has been is blocked via the third control edge (47), the third control edge (47) blocking the fluid connection between the high pressure inlet (A) and the setting pressure during on a transition of the control piston (31) into an end abutment position during the emergency operation.

2. An axial piston machine in accordance with claim 1, wherein the setting pressure connection comprises at least one radial setting pressure bore (35).

3. An axial piston machine in accordance with claim 2, wherein the setting pressure connection comprises a plurality of radial setting pressure bores (35) distributed uniformly over a periphery of the control piston (31).

4. An axial piston machine in accordance with claim 1, wherein the third and fourth control edges (47, 48) are formed in a region through which hydraulic fluid flows during normal operation with an active external control of the control valve (30).

5. An axial piston machine in accordance with claim 1, wherein the control piston (31) has a setting pressure groove (35*a*), a high pressure groove (42), and a low pressure groove (44) that are separated from one another via interposed webs (43, 45); and a connection groove (36) formed as an inner radial groove is provided in an inner wall of the valve housing (32), wherein a fluid connection between the high pressure inlet (A) and the setting pressure connection via the high pressure groove (42), the connection groove (36), and the setting pressure groove (35*a*) is able to be established during the operation with an active external control of the control valve (30), and wherein a fluid connection between the low pressure inlet (T) and the setting pressure connection is able to be established during the operation with an active external control of the control valve (30) via the low pressure groove (44), the connection groove (36), and the setting pressure groove (35*a*).

6. An axial piston machine in accordance with claim 5, wherein the setting pressure connection opens into the setting pressure groove (35*a*), wherein the webs (43, 45) bound the setting pressure groove (35*a*) respectively and each said web has at least one cutout (60) in a region of an opening of the setting pressure connection that forms a common volume with a respective the low pressure or and/or high pressure groove (42, 44) and reduces a width of the respective web (43, 45), and wherein the cutouts (60) each have a width reducing toward the setting pressure groove (35*a*), wherein the first and/or second control edge(s) (41, 46) are formed at the regions of reduced width of the webs (43, 45).

7. An axial piston machine in accordance with claim 5, wherein a connection takes place between the low pressure inlet (T) or the high pressure inlet (A) and the setting pressure connection directly via the setting pressure groove (35*a*).

8. An axial piston machine in accordance with claim 5, wherein the setting pressure groove (35*a*), the high pressure groove (42), and the low pressure groove (44) are configured as peripheral outer radial grooves.

9. An axial piston machine in accordance with claim 1, wherein the control piston (31) is designed as a hollow piston and the setting pressure connection is permanently connected to the adjustment chamber (34) via a hollow space (33*a*).

10. An axial piston machine in accordance with claim 9, wherein a feedback spring (33) is arranged within the hollow space (33*a*) of the control piston (31) and whose spring force acts against a setting force on the control piston (31) generated by the control signal, wherein the spring force increases as the pivot angle of the swash plate (6) increases.

11. An axial piston machine in accordance with claim 9, wherein a volume is present between a base of the bore (31*a*) for receiving the control piston (31) and a front surface (38) of the control piston (31) facing the base, wherein the volume is connected to the hollow space (33*a*) of the control piston (31) via an axial bore (37), wherein the axial bore (37) has a diameter constriction.

12. An axial piston machine in accordance with claim 1, wherein the control valve (30) is hydraulically controlled, wherein a corresponding control pressure chamber is formed by a radial groove (54) at an outer periphery of the control piston (31) and an annular space is formed between the control piston (31) and the valve housing (32), and wherein a smaller control pressure is required to open the first control edge (41) than to open the second control edge (46).

13. An axial piston machine in accordance with claim 1, wherein a setting pressure of the adjustment chamber (34) acts on a setting piston (22) of the adjustment device (20), wherein a pressure-caused axial displacement of the setting piston (22) is transferred to the swash plate (6) via a setting lever (21).

14. An axial piston machine in accordance with claim 13, wherein the bore (31*a*) has an increased bore diameter in a region of an interface to the adjustment device (20) and a ring (39) is disposed in a space disposed between the control piston (31) and the setting piston (22), wherein said ring (39) is seated coaxially on an outer periphery of the control piston (31), wherein the ring (39) is fixed by a shaft securing ring (39*a*), and wherein the ring (39) or the shaft securing ring (39*a*) forms an end abutment of the control piston (31).

15. An axial piston machine in accordance with claim 1, wherein an end abutment of the control piston (31) is formed by a base of the bore (31*a*).

16. An axial piston machine in accordance with claim 1, wherein the control valve (30) is designed in a cartridge construction such that a valve cartridge of the control valve (30) is introduced or screwed into a housing (8) of the axial piston machine from the outside, wherein the control valve (30) is arranged in a connection plate (11) of the axial piston machine.

17. An axial piston machine in accordance with claim 1, wherein a maximum or minimum pivot angle of the swash plate (6) is present at a respective maximum or minimum driving mechanism piston stroke.

18. An axial piston machine in accordance with claim 1, wherein at least one integrated or attached regulation valve is connected to the low pressure inlet (T) of the control valve (30), with the low pressure inlet (T) being able to be acted on by a pressure level above a tank pressure level by the at least one regulation valve.

19. An axial piston machine in accordance with claim 18, wherein a pressure cutoff stage and/or a load sensing stage (51, 52) is connected to the low pressure inlet (T) of the control valve (30).

20. An axial piston machine in accordance with claim 1, wherein an integrated or attached valve is connected to the low pressure inlet (T) of the control valve (30), wherein the low pressure inlet (T) is connectable by the integrated or attached valve to a hydraulic tank or, for applying a pressure level above a tank pressure level, to a hydraulic source.

21. An axial piston machine in accordance with claim 20, wherein the integrated or attached valve is a 2/2 way valve.

22. An axial piston machine in accordance with claim 1, wherein the control valve (30) has a control pressure inlet (ST) that is connected to a control pressure chamber (40, 54) and in which there is an externally provided control pressure, wherein an axial position of the control piston (31) depends on the amount of the control pressure, and wherein the control valve (30) is configured such that it automatically switches into emergency operation upon a failure of the control pressure.

23. An axial piston machine in accordance with claim 22, wherein a pressure monitoring device is provided by which the pressure applied to the control pressure inlet (ST) is detectable and is comparable with a desired value, wherein the control pressure inlet (ST) is able to be acted on by a tank pressure level or a settable pressure level upon a presence of a deviation of the measured control pressure from the desired value.

* * * * *